US005213952A

United States Patent [19]

Kuwashima et al.

[11] Patent Number: 5,213,952

[45] Date of Patent: May 25, 1993

[54] METHOD OF FORMING DIRECT POSITIVE COLOR IMAGE

[75] Inventors: Shigeru Kuwashima; Akihiko Ikegawa, both of Kanagawa, Japan

[73] Assignee: Fuji Photo Film Co., Ltd., Kanagawa, Japan

[21] Appl. No.: 607,186

[22] Filed: Oct. 31, 1990

[30] Foreign Application Priority Data

Nov. 1, 1989 [JP] Japan ..... 1-285157

[51] Int. Cl.[5] ..... G03C 1/08

[52] U.S. Cl. ..... 430/378; 430/547; 430/599; 430/600; 430/940; 430/570; 430/598

[58] Field of Search ..... 430/547, 599, 600, 940, 430/378, 570, 598

[56] References Cited

U.S. PATENT DOCUMENTS

| | | | |
|---|---|---|---|
| 4,138,258 | 2/1979 | Hirose et al. | 430/562 |
| 4,618,570 | 10/1986 | Kadowaki et al. | 430/505 |
| 4,837,143 | 6/1989 | Komorita et al. | 430/621 |
| 4,840,879 | 6/1989 | Kamitakahara et al. | 430/406 |
| 4,859,579 | 8/1989 | Hirano et al. | 430/598 |
| 4,880,727 | 11/1989 | Inoue et al. | 430/378 |
| 4,920,040 | 4/1990 | Ono | 430/363 |
| 4,968,592 | 11/1990 | Deguchi et al. | 430/378 |
| 4,968,596 | 11/1990 | Inoue et al. | 430/598 |
| 4,994,364 | 2/1991 | Inoue et al. | 430/598 |

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method of forming a direct positive color image by imagewise exposing a photographic material having at least one emulsion layer which contains previously non-fogged internal latent image-type silver halide grains, on a support, followed by color-developing the exposed material during or after fogging thereof, wherein the photographic material contains a color sensitizing dye and at least one compound or salt thereof which satisfies the condition-1 as defined in the specification. With the image formed by the method having an elevated maximum image density with a lowered minimum image density, and with the iamge-forming method displaying extremely excellent color reproducibility.

8 Claims, No Drawings

METHOD OF FORMING DIRECT POSITIVE COLOR IMAGE

FIELD OF THE INVENTION

The present invention relates to a method of forming a direct positive color image and, in particular, to a method for forming a direct positive color image in which a photographic material having an emulsion layer containing not previously fogged internal latent image-type silver halide grains is color-developed without elevating the minimum image density but with elevating the maximum image density along with an improvement of the color sensitizing range so as to improve the color reproducibility.

BACKGROUND OF THE INVENTION

A photographic process for forming a direct positive image without the necessity of either a reversal processing step or a negative film is well known.

The method of forming a positive image by the use of a conventional known direct positive silver halide photographic material may be classified into the following two groups, with certain exceptions, in considering the practical usefulness thereof.

One group uses a previously fogged silver halide emulsion, in which the fogged nuclei (latent image) in the exposed area are broken by solarization or the Herschel effect and the intended positive image is directly obtained by development.

The other group uses a non-fogged internal latent image-type silver halide emulsion, in which surface development is effected after imagewise exposure and after or during fogging to obtain a direct positive image.

An internal latent image-type silver halide photographic emulsion as referred to herein means a silver halide photographic emulsion of a type such that the silver halide grains in the emulsion have light-sensitive nuclei essentially in the inside thereof and therefore a latent image is formed essentially in the inside of the grains by exposure.

The method of the latter type generally provides a higher sensitivity than that of the former type and is therefore suitable for uses requiring high sensitivity. The method of the present invention belongs to the method of the latter type.

In this technical field, various techniques are known, for instance, as disclosed in U.S. Pat. Nos. 2,592,250, 2,468,957, 2,497,875, 2,588,982, 3,317,322, 2,497,875, 3,761,266, 3,761,276, 3,796,577, and British Patents 1,151,363, 1,150,553 and 1,011,062. Using the disclosed known methods, direct positive photographic materials having a relatively high sensitivity can be obtained.

On the other hand, the details of the mechanism of forming direct positive images are described, for example, in T.H. James, *The Theory of the Photographic Process*, 4th Ed., Chap. 7, pages 182 to 193 and U.S. Pat. No. 3,761,276.

More specifically, it is believed that fogged nuclei are selectively formed on only the surfaces of the silver halide grains in the non-exposed area due to the surface desensitization action occurring due to a so-called internal latent image formed in the inside of the silver halide by the first imagewise exposure and thereafter a photographic image (direct positive image) is formed in the non-exposed area by the subsequent surface development.

As mentioned above, means of selectively forming fogged images, in general, include a so-called "light-fogging method" where a second exposure is imparted to the complete surface of a light-sensitive layer (for example, British Patent 1,151,363) and a so-called "chemical fogging method" where a nucleating agent is used. The latter method is described, for example, in *Research Disclosure*, Vol. 151, No. 15162 (issued on November, 1976), pages 72 to 87.

For forming a direct positive color image, an internal latent image-type silver halide photographic material is subjected to surface color-development, after or during fogging, and thereafter it is bleached (or bleach-fixed). After bleaching and fixation, the material is then generally rinsed in water and/or stabilized.

On the other hand, JP-A-62-150241 and JP-A-62-275242 (the term "JP-A" as used herein means an "unexamined published Japanese patent application") illustrate direct positive photographic materials having a low-sensitivity emulsion containing cubic or essentially (100) face tetradecahedral silver halide grains. These publications disclose photographic materials forming black-and-white direct positive images, in which the exposure latitude of forming black-and-white direct positive images and the graininess of the images formed are improved.

With respect to the above-mentioned method of forming a direct positive image by the use of a non-fogged internal latent image-type silver halide emulsion, various techniques for increasing the maximum image density and decreasing the minimum image density have heretofore been proposed, but a sufficiently improved technique has not been attained at the present time. In particular, the minimum image density would often increase, depending upon the kind of the sensitizing dye used and the method of sensitizing the layer, in a sensitizing dye-containing red-sensitive layer or green-sensitive layer. Therefore, the improvement of the color reproducibility to be attained by optimized color sensitization and the reproduction of the whiteness in the white background areas of the image to be attained by a decrease in the minimum image density would often be contradictory to each other.

The above-mentioned chemical fogging method using a nucleating agent is grouped into a case where the nucleating agent is incorporated in a photographic material and a case where it is incorporated in a color developer. However, the former case has a problem, that the minimum image density increases or the maximum image density is decreased during storage of the photographic material.

Where the emulsion as described in the above-mentioned JP-A-62-150241, which contains cubic or essentially (100) face tetradecahedral silver halide grains, is employed in the formation of color images, an improvement in the color reproducibility by optimization of color sensitization could be attained relatively easily but the direct positive color image obtained still does not have a satisfactorily high maximum image density and a satisfactorily low minimum image density despite the improved color reproducibility. Accordingly, a solution to the problem is desired.

SUMMARY OF THE INVENTION

In order to overcome the problems in the above-described prior art techniques, the present invention provides a method of forming a direct positive color image comprising image-wise exposing a photographic material having at least one emulsion layer which contains not previously fogged internal latent image-type silver halide grains, on a support and then color-developing the exposed photographic material in the presence of a nucleating agent or under a light-fogging exposure, wherein the photographic material contains (A) a color sensitizing dye and (B) at least one compound or salt thereof which satisfies the following condition-1.

Condition-1:

2 ml of an aqueous solution of $4.0\times10^{-4}$ mol/liter of anhydro-5,5'-dichloro-9-ethyl-3,3'-bis(3-sulfopropyl)-thiacarbocyanine-hydroxide pyridinium salt and 1 ml of an aqueous solution $1.0\times10^{-1}$ mol/liter of potassium chloride are blended, and 4 ml of an aqueous solution of $8.0\times10^{-2}$ mol/liter of the compound (B) to be added to the photographic material is added to the resulting blended solution, which is then diluted with water to make 10 ml; with the molecular extinction coefficient of the resulting aqueous solution at 624 nm being $1.0\times10^{5}$ or less.

As one preferred embodiment of the method of the invention, at least one compound or salt thereof, which satisfies the above-mentioned condition-1, is added to the silver halide photographic material prior to addition of a color sensitizing dye thereto.

As another preferred embodiment of the method of the invention, the silver halide grains of the light-sensitive emulsion of the photographic material are cubic grains or essentially (100) face tetradecahedral grains.

DETAILED DESCRIPTION OF THE INVENTION

A broad range compounds to be added to the photographic material of the invention and which satisfy condition-1 can be used, and cyclic compounds are preferred. Especially preferred are compounds of the following general formulae (I), (II), (III) and (IV), as well as dicyclic to tetracyclic heterocyclic compounds. These compounds preferably have a molecular weight of 600 or less. Most preferred are dicyclic to tetracyclic heterocyclic compounds.

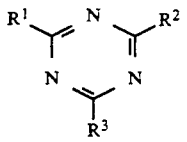

(I)

where $R^1$, $R^2$ and $R^3$ may be same or different and each represents a hydrogen atom, a halogen atom, —OM (in which M represents a hydrogen atom or a monovalent metal such as Na, K or Li), a substituted or unsubstituted alkyl group, a substituted or unsubstituted aryl group, a substituted or unsubstituted alkoxy group, a substituted or unsubstituted amino group, a sulfo group, a substituted or unsubstituted aryloxy group, a substituted or unsubstituted alkylthio group, a substituted or unsubstituted arylthio group, or a substituted or unsubstituted aminothiocarbonylthio group.

The alkyl group is preferably one having 20 or less carbon atoms, which includes, for example, methyl group, ethyl group, 2-hydroxyethyl group, 2-diethylaminoethyl group, propyl group, isopropyl group, 3-dimethylaminopropyl group, pentyl group, isopentyl group, hexyl group, cyclohexyl group, heptyl group, benzyl group and octadecyl group. The aryl group is preferably one having 15 or less carbon atoms, which includes, for example, phenyl group, tolyl group, sulfonyl group, carboxyphenyl group, naphthyl group and sulfonaphthyl group. The alkoxy group is preferably one having 20 or less carbon atoms, which includes, for example, methoxy group, ethoxy group, propyloxy group, butoxy group and octadecyloxy group. The substituted amino group is preferably one having 20 or less carbon atoms, which includes, for example, dimethylamino group, diethylamino group, hydroxyamino group, 2-hydroxyethylamino group, 2-sulfoethylamino group, 2-diethylaminoethylamino group, anilino group and β-naphthylamino group. The aryloxy group is preferably one having 20 or less carbon atoms, which includes, for example, phenoxy group, 4-sulfophenoxy group and β-naphthyloxy group. The alkylthio group is preferably one having 20 or less carbon atoms, which includes, for example, methylthio group, ethylthio group, 2-hydroxyethylthio group, 2-diethylaminoethylthio group and dodecylthio group. The arylthio group is preferably one having 20 or less carbon atoms, which includes, for example, phenylthio group, β-naphthylthio group and 4-sulfophenylthio group. The substituted aminothiocarbonylthio group is preferably one having 15 or less carbon atoms, which includes, for example, dimethylaminothiocarbonylthio group, diethylaminothiocarbonylthio group and phenylaminothiocarbonylthio group.

$$A—(L)_n—B \qquad (II)$$

where

A and B may be same or different and each represents a substituted or unsubstituted heterocyclic group;

L represents a divalent linking group; and n represents 0 or 1.

The heterocyclic group represented by A or B is preferably a residue of a 5-membered, 6-membered or 7-membered ring or a condensed ring thereof, which may optionally be substituted. The substituent is represented by, for example, $R^1$, $R^2$ and $R^3$ as defined above.

The linking group represented by L is preferably an optionally substituted $C_{1-8}$ aliphatic or $C_{6-15}$ aromatic divalent organic residue, or an oxygen atom, a sulfur atom or a selenium atom.

Examples of heterocyclic groups represented by A or B include a furyl group, a thienyl group, a pyrrolyl group, a triazinyl group, a triazolyl group, an imidazolyl group, a pyridyl group, a pyrimidinyl group, a pyrazinyl group, a quinazolinyl group, a purinyl group, a quinolinyl group, an acridinyl group, an indolyl group, a thiazolyl group, an oxazolyl group and a furazanyl group.

Examples of organic residues of the linking group represented by L include a methylene group, an ethylene group, a phenylene group, a propylene group, a 1-oxo-2-butenyl-1,3-ene group, a p-xylene-α,α'-diyl group, an ethylenedioxy group, a succinyl group and a malonyl group.

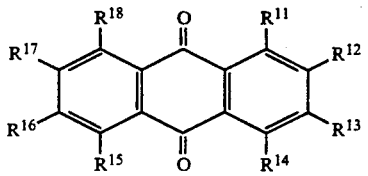

(III)

where $R^{11}$, $R^{12}$, $R^{13}$, $R^{14}$, $R^{15}$, $R^{16}$, $R^{17}$ and $R^{18}$ may be same or different and each represents a hydrogen atom, a halogen atom, —OM (in which M represents a hydrogen atom or a monovalent atom such as Na, K or Li), a substituted or unsubstituted alkyl group, a substituted or unsubstituted aryl group, a substituted or unsubstituted alkoxy group, a substituted or unsubstituted amino group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, or a substituted or unsubstituted aminocarbonyl group.

In particular, the alkyl group is preferably one having 20 or less carbon atoms, which includes, for example, methyl group, ethyl group, 2-hydroxyethyl group, 2-diethylaminoethyl group, propyl group, isopropyl group, 3-dimethylaminopropyl group, pentyl group, isopentyl group, hexyl group, cyclohexyl group, heptyl group, benzyl group and octadecyl group. The aryl group is preferably one having 15 or less carbon atoms, which includes, for example, phenyl group, tolyl group, sulfophenyl group, carboxyphenyl group, naphthyl group and sulfonaphthyl group. The alkoxy group is preferably one having 20 or less carbon atoms, which includes, for example, methoxy group, ethoxy group, propyloxy group, butoxy group and octadecyloxy group. The substituted amino group is preferably one having 20 or less carbon atoms, which includes, for example, dimethylamino group, diethylamino group, hydroxyamino group, 2-hydroxyethylamino group, 2-sulfoethylamino group, 2-diethylaminoethylamino group, anilino group and β-naphthylamino group. The aryloxy group is preferably one having 20 or less carbon atoms, which includes, for example, phenoxy group, 4-sulfophenoxy group and β-naphthyloxy group. The alkylthio group is preferably one having 20 or less carbon atoms which includes, for example, methylthio group, ethylthio group, 2-hydroxyethylthio group, 2-diethylaminoethylthio group and dodecylthio group. The arylthio group is preferably one having 20 or less carbon atoms, which includes, for example, phenylthio group, β-naphthylthio group and 4-sulfophenylthio group. The acyl group is preferably one having 20 or less carbon atoms, which includes, for example, acetyl group, propionyl group, butyryl group, stearoyl group and benzoyl group. The substituted aminosulfonyl group is preferably one having 20 or less carbon atoms, which includes, for example, diethylaminosulfonyl group, di(2-hydroxyethyl)aminosulfonyl group, anilinosulfonyl group, 2-sulfoethylaminocarbonyl group and dodecylaminosulfonyl group. The alkoxycarbonyl group is preferably one having 20 or less carbon atoms, which includes, for example, methoxycarbonyl group, ethoxycarbonyl group, methoxyethoxycarbonyl group, diethylaminoethoxycarbonyl group and benzyloxycarbonyl group. The aryloxycarbonyl group is preferably one having 20 or less carbon atoms, which includes, for example, phenoxycarbonyl group, 4-sulfophenoxycarbonyl group and tolyloxycarbonyl group. The substituted aminocarbonyl group is preferably one having 20 or less carbon atoms, which includes, for example, dimethylaminocarbonyl group, diethylaminocarbonyl group, propylaminocarbonyl group, octadecylaminocarbonyl group and 2-sulfoethylaminocarbonyl group.

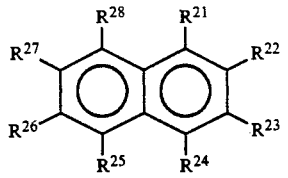

(IV)

where $R^{21}$, $R^{22}$, $R^{23}$, $R^{24}$, $R^{25}$, $R^{26}$, $R^{27}$ and $R^{28}$ may be same or different and each represents a hydrogen atom, a halogen atom, —OM (in which M represents a hydrogen atom or a monovalent metal such as Na, K or Li), a substituted or unsubstituted alkyl group, a substituted or unsubstituted aryl group, a substituted or unsubstituted alkoxy group, a substituted or unsubstituted amino group, a mercapto group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted aminocarbonyl group, a substituted or unsubstituted alkoxycarbonyl group, a substituted or unsubstituted aryloxycarbonyl group, or a substituted or unsubstituted aminocarbonyl group; and $R^{21}$ and $R^{22}$, $R^{22}$ and $R^{23}$, $R^{23}$ and $R^{24}$, $R^{24}$ and $R^{25}$, $R^{25}$ and $R^{26}$, $R^{26}$ and $R^{27}$, or $R^{27}$ and $R^{28}$ may optionally form a substituted or unsubstituted condensed benzene ring.

In particular, the alkyl group is preferably one having 20 or less carbon atoms, which includes, for example, methyl group, ethyl group, 2-hydroxyethyl group, 2-diethylaminoethyl group, propyl group, isopropyl group, 3-dimethylaminopropyl group, pentyl group, isopentyl group, hexyl group, cyclohexyl group, heptyl group, benzyl group and octadecyl group. The aryl group is preferably one having 15 or less carbon atoms, which includes, for example, phenyl group, tolyl group, sulfophenyl group, carboxyphenyl group, naphthyl group and sulfonaphthyl group. The alkoxy group is preferably one having 20 or less carbon atoms, which includes, for example, methoxy group, ethoxy group, propyloxy group, butoxy group and octadecyloxy group. The substituted amino group is preferably one having 20 or less carbon atoms, which includes, for example dimethylamino group, diethylamino group, hydroxyamino group, 2-hydroxyethylamino group, 2-sulfoethylamino group, 2-diethylaminoethylamino group, anilino group and β-naphthylamino group. The aryloxy group is preferably one having 20 or less carbon atoms, which includes, for example, phenoxy group, 4-sulfophenoxy group and β-naphthyloxy group. The alkylthio group is preferably one having 20 or less carbon atoms, which includes, for example, methylthio group, ethylthio group, 2-hydroxyethylthio group, 2-diethylaminoethylthio group and dodecylthio group. The arylthio group is preferably one having 20 or less carbon atoms, which includes, for example, phenylthio group, β-naphthylthio group and 4-sulfophenylthio group. The acyl group is preferably one having 20 or less carbon atoms, which includes, for example, acetyl group, propionyl group, butyryl group, stearoyl group and benzoyl group. The substituted aminosulfonyl group is preferably one having 20 or less carbon atoms, which includes, for example, diethylaminosulfonyl group, di(2-hydroxyethyl) aminosulfonyl group, anilinosulfonyl group, 2-sulfoethylaminosulfonyl group and dodecylaminosulfonyl group. The alkoxycarbonyl group is preferably one having 20 or less carbon atoms, which includes, for example, methoxycarbonyl group, ethoxycarbonyl group, methoxyethoxycarbonyl group, diethylaminoethoxycarbonyl group and benzyloxycarbonyl group. The aryloxycarbonyl group is preferably one having 20 or less carbon atoms, which includes, for example, phenoxycarbonyl group, 4-sulfophenyloxycarbonyl group and tolyloxycarbonyl group. The substituted aminocarbonyl group is preferably one having 20 or less carbon atoms, which includes, for example, dimethylaminocarbonyl group, diethylaminocarbonyl group, propylaminocarbonyl group, octadecylaminocarbonyl group and 2-sulfoethylaminocarbonyl group.

The compounds which satisfy the condition-1 may be in the form of salts thereof with inorganic or organic acids. Preferred examples of inorganic or organic acids for forming salts are hydrochloric acid, sulfuric acid, nitric acid, hydrobromic acid, hydroiodic acid, perchloric acid, oxalic acid, p-toluenesulfonic acid, methanesulfonic acid and trifluroromethanesulfonic acid.

The compounds which satisfy the condition-1 for use in the present invention are preferably those having a molecular weight of 600 or less, more preferably 500 or less.

Specific examples of compounds which satisfy the condition-1 and which can be used in the present invention are described below, which, however, do not whatsoever restrict the scope of the present invention.

(1)

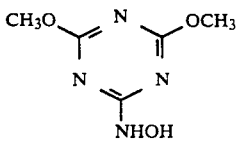

(2)

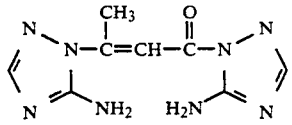

(3)

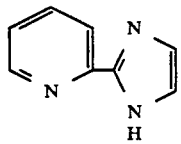

(4)

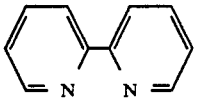

(5)

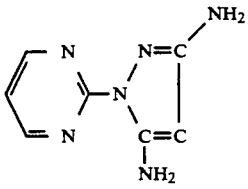

-continued (6)

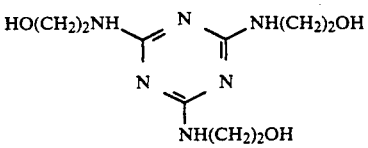

(7)

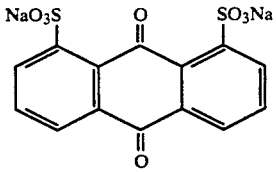

(8)

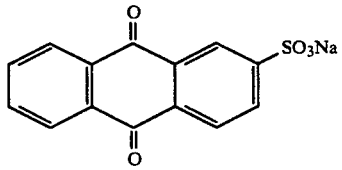

(9)

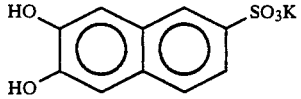

(10)

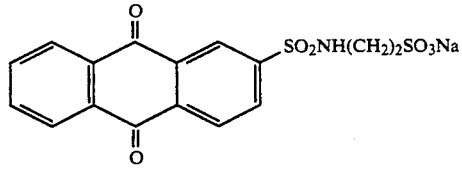

(11)

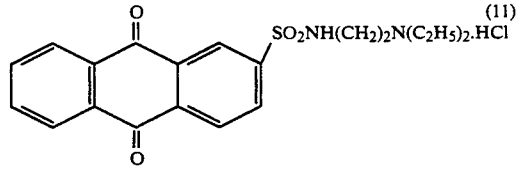

(12)

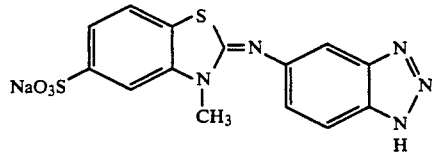

(13)

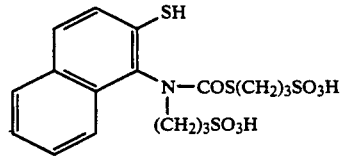

(14)

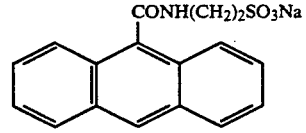

The molecular extinction coefficient of an aqueous solution of each of the above-mentioned compounds, which has been prepared to satisfy the condition-1, at 624 nm was measured, and the data obtained are shown below.

TABLE A

| Compound | Molecular Weight | Molecular Extinction Coefficient |
|---|---|---|
| (1) | 112 | $0.17 \times 10^5$ |
| (2) | 224 | $0.20 \times 10^5$ |
| (3) | 145 | 0 |
| (4) | 156 | 0 |
| (5) | 177 | 0 |
| (6) | 258 | $0.63 \times 10^5$ |
| (7) | 412 | 0 |
| (8) | 310 | 0 |
| (9) | 263 | 0 |
| (10) | 417 | 0 |
| (11) | 429 | 0 |
| (12) | 360 | 0 |
| (13) | 351 | 0 |
| (14) | 351 | 0 |

As shown above, all the compounds have a molecular extinction coefficient of less than $1.0 \times 10^5$ as an aqueous solution and have a molecular weight of less than 500.

In the present invention, a "molecular extinction coefficient" means a value which is obtained by dividing an absorbance by the thickness of an absorbing layer and the molar density of a solute, which is well known.

Most compounds which satisfy the condition-1 are easily available as commercial products or may easily be derived from commercially available products. For instance, the above-mentioned examples of the compounds may easily be produced by reference to the methods described in Smolin and Rapoport, *Heterocyclic Compounds - S - Triazine and Derivatives* (Interscience Publishers, 1959); Temple, *Heterocyclic Compounds Triazine* 1,2,4 (John Wiley & Sons, 1981); Hofmann, *Heterocyclic Compounds—Imidazole and Derivatives* (1953); Metzger, *Heterocyclic Compounds Thiazole and Its Derivatives* (John Wiley & Sons, 1979); and Klinsberg, *Heterocyclic Compounds—Pyridine and Derivatives* (Interscience Publishers, 1960); and some of them are commercially available.

Preferred examples of dicyclic to tetracyclic hetero rings which can also be employed in the present invention, are benzothiazole, benzoxazole, benzoselenazole, benzotellurazole, benzimidazole, indole, isoindole, indolenine, indoline, indazole, chromene, chroman, isochroman, quinoline, isoquinoline, quinolidine, cinnoline, phthalazine, quinazoline, quinoxaline, naphthylidine, purine, puteridine, indolidine, benzofuran, isobenzofuran, benzothiophene, benzopyrane, benzoazepine, benzoxazine, cyclopentapyran, cycloheptaisoxazole, benzothiazapine, pyrazolotriazole, tetrazaindene, naphthothiazole, naphthoxazole, naphthoselenazole, naphthotellurazole, naphthoimidazole, carbazole, xanthene, phenanthridine, acridine, perimidine, phenanthroline, thianthrene, phthoxathiin, phenoxazine, phenothiazine and phenazine; as well as condensed polycyclic compounds composed of the hetero ring and other cyclic hydrocarbons such as benzene or naphthalene or other hetero rings such as furan, thiophene, pyrrole, pyran, thiopyran, pyridine, oxazole, isoxazole, thiazole, isothiazole, imidazole, pyrazole, pyrazine, pyrimidine or pyridazine.

In particular, compounds having any of the following hetero rings are preferably employed in the present invention.

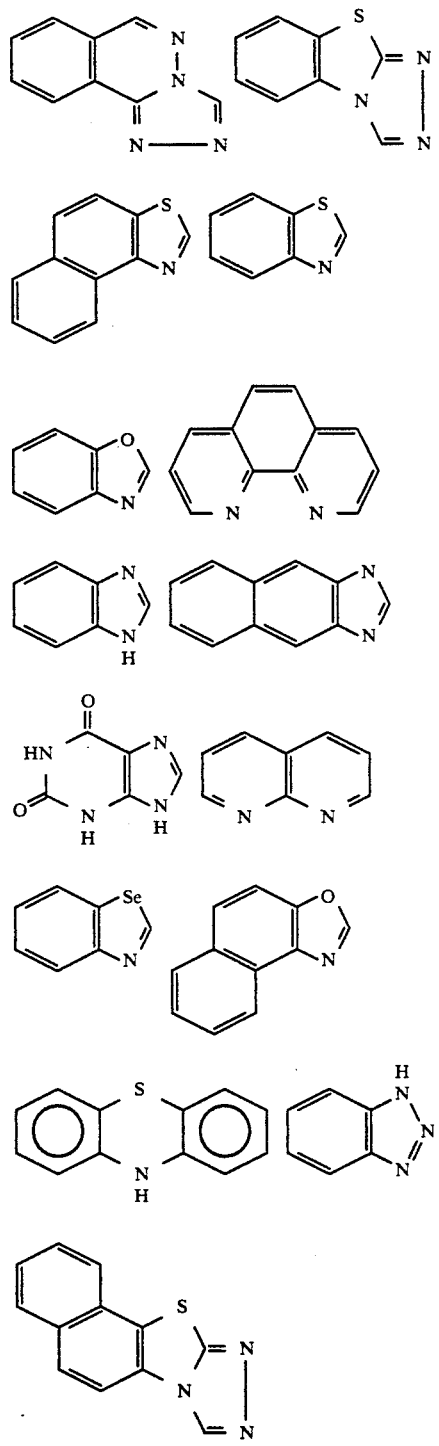

The above-described polycyclic compounds which can be used in the present invention may optionally have substituent(s). Preferred substituents in such compounds include, for example, a halogen atom, —OM (in which M represents a hydrogen atom or a monovalent metal such as Na, K or Li), a substituted or unsubstituted alkyl group, a substituted or unsubstituted aryl group, a substituted or unsubstituted alkoxy group, a substituted or unsubstituted amino group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, and a substituted or unsubstituted aminocarbonyl group.

The alkyl group is preferably one having 20 or less carbon atoms, which includes, for example, methyl group, ethyl group, 2-hydroxyethyl group, 2-diethylaminoethyl group, propyl group, isopropyl group, 3-dimethylaminopropyl group, pentyl group, isopentyl group, hexyl group, cyclohexyl group, heptyl group, benzyl group and octadecyl group. The aryl group is preferably one having 15 or less carbon atoms, which includes, for example, phenyl group, tolyl group, sulfophenyl group, carboxyphenyl group, naphthyl group and sulfonaphthyl group. The alkoxy group is preferably one having 20 or less carbon atoms, which includes, for example, methoxy group, ethoxy group, propyloxy group, butoxy group and octadecyloxy group. The substituted amino group is preferably one having 20 or less carbon atoms, which includes, for example, dimethylamino group, diethylamino group, hydroxyamino group, 2-hydroxyethylamino group, 2-sulfoethylamino group, 2-diethylaminoethylamino group, anilino group and $\beta$-naphthylamino group. The aryloxy group is preferably one having 20 or less carbon atoms, which includes, for example, phenoxy group, 4-sulfophenoxy group and $\beta$-naphthyloxy group. The alkylthio group is preferably one having 20 or less carbon atoms which includes, for example, methylthio group, ethylthio group, 2-hydroxyethylthio group, 2-diethylaminoethylthio group, dodecylthio group, 2-sulfoethylthio group, 3-sulfopropylthio group and 4-sulfobutylthio group. The arylthio group is preferably one having 20 or less carbon atoms, which includes, for example, phenylthio group, $\beta$-naphthylthio group and 4-sulfophenylthiogroup. The acyl group is preferably one having 20 or less carbon atoms, which includes, for example, acetyl group, propionyl group, butyryl group, stearoyl group and benzoyl group. The substituted aminosulfonyl group is preferably one having 20 or less carbon atoms, which includes, for example, diethylaminosulfonyl group, di(2-hydroxyethyl)aminosulfonyl group, anilinosulfonyl group, 2-sulfoethylaminocarbonyl group and dodecylaminosulfonyl group. The alkoxycarbonyl group is preferably one having 20 or less carbon atoms, which includes, for example, methoxycarbonyl group, ethoxycarbonyl group, methoxyethoxycarbonyl group, diethylaminoethoxycarbonyl group and benzyloxycarbonyl group. The aryloxycarbonyl group is preferably one having 20 or less carbon atoms, which includes, for example, phenoxycarbonyl group, 4-sulfophenyloxycarbonyl group and tolyloxycarbonyl group. The substituted aminocarbonyl group is preferably one having 20 or less carbon atoms, which includes, for example, dimethylaminocarbonyl group, diethylaminocarbonyl group, propylaminocarbonyl group, octadecylaminocarbonyl group and 2-sulfoethylaminocarbonyl group.

The above-mentioned polycyclic compounds may be in the form of salts with inorganic or organic acids. Preferred examples of inorganic or organic acids, which can be used for forming such salts include hydrochloric acid, sulfuric acid, nitric acid, hydrobromic acid, hydroiodic acid, perchloric acid, oxalic acid, p-toluenesulfonic acid, methanesulfonic acid and trifluoromethanesulfonic acid.

Specific examples of polycyclic compounds which may be employed in the present invention are described below, but these do not whatsoever restrict the scope of the present invention.

(21)

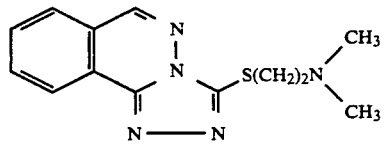

(22)

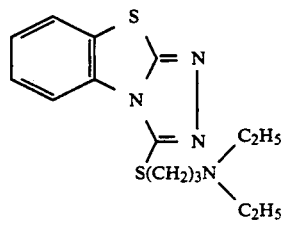

(23)

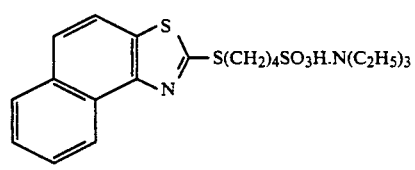

(24)

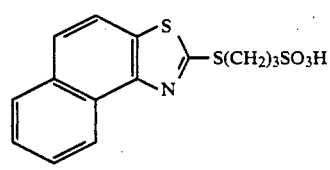

(25)

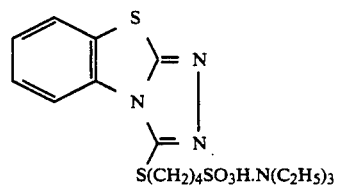

(26)

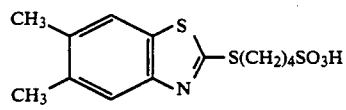

(27)

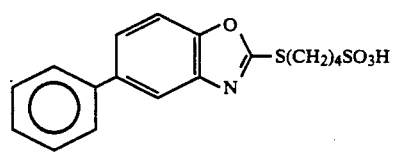

(28)

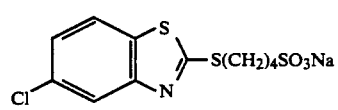

(29)

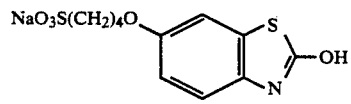

-continued (30)

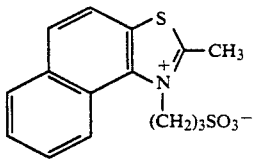

(31)

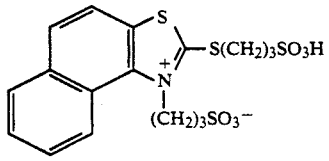

(32)

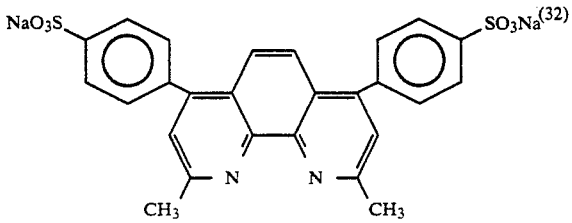

(33)

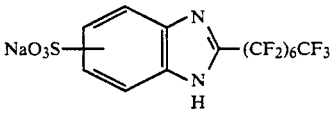

(34)

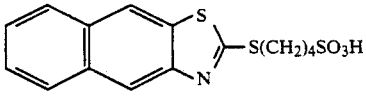

(35)

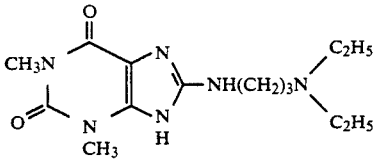

(36)

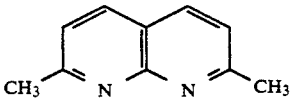

(37)

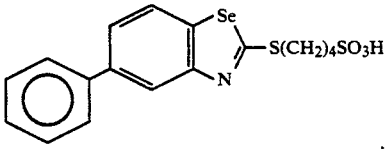

(38)

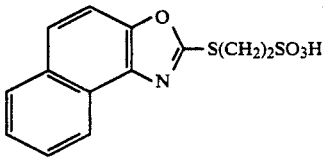

-continued (39)

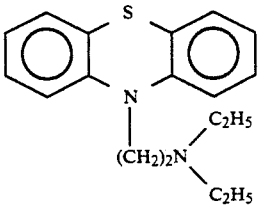

(40)

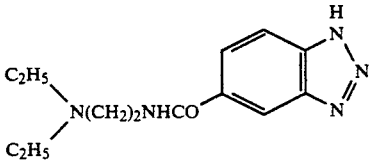

(41)

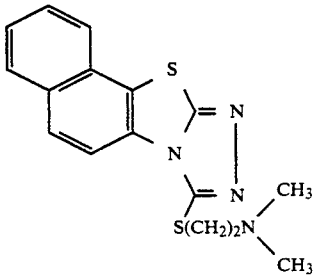

(42)

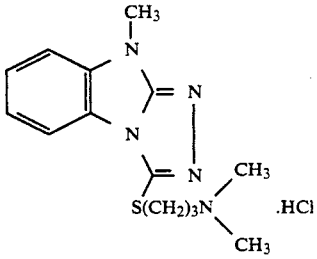

The molecular extinction coefficient of each of the illustrated compounds at 624 nm was measured, in the form of an aqueous solution prepared to satisfy the above-defined condition-1, and the measured molecular extinction coefficient of all the compounds was a value of 0 (zero). Additionally, all the compounds had a molecular weight of less than 600.

The polycyclic compounds for use in the present invention can easily be prepared, for example, by the methods described in Metzger, *Heterocyclic Compounds— Thiazole and Its Derivatives* (John Wiley & Sons, 1979); Castle, *Heterocyclic Compounds—Condensed Pyridazines Including Cinnolines and Phthalazines* (John Wiley & Sons, 1973); and Potts, *Comprehensive Heterocyclic Chemistry,* Vol 6 (Pergamon Press, 1984).

In accordance with the present invention, the compound or its salt which satisfies the condition-1 is incorporated into the photographic material, preferably in an amount of from $10^{-4}$ to $10^{-1}$ mol per mol of the silver halide in the material. Additionally, it is preferred that the compound or its salt is added to the silver halide emulsion of the material prior to addition of a color sensitizing dye thereto.

Example of color sensitizing dyes to be added to the photographic material of the present invention include compounds of the following general formula (V) which are preferably employed. These compounds are explained in detail hereunder.

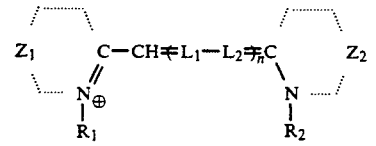

(V)

In the formula, $Z_1$ and $Z_2$ may be same or different and each represents an atomic group necessary for forming a benzothiazole nucleus, a naphthothiazole nucleus, a benzoxazole nucleus, a naphthoxazole nucleus, a benzimidazole nucleus, a benzoselenazole nucleus or a naphthoselenazole nucleus.

$R_1$ and $R_2$ may be same or different and each represents an unsubstituted alkyl group or a substituted alkyl group, provided that at least one of $R_1$ and $R_2$ must include a sulfo group or a carboxyl group.

$L_1$ and $L_2$ may be same or different and each represents a substituted or unsubstituted methine group.

n represents an integer of from 0 to 2.

The nuclei formed by $Z_1$ and $Z_2$ may have substituents, as is well known in the field of cyanine dyes. Examples of such substituents include a $C_{1-8}$ alkyl group, a $C_{1-8}$ alkoxy group, a $C_{1-9}$ alkoxycarbonyl group, a $C_{6-15}$ aryl group, a $C_{7-16}$ aralkyl group, and a halogen atom.

$R_1$ and $R_2$ may be same or different. The alkyl group represented by $R_1$ or $R_2$ is preferably one having from 1 to 8 carbon atoms, which includes, for example, methyl group, ethyl group, propyl group, butyl group, pentyl group and hexyl group. Examples of substituents for the substituted alkyl group are, for example, a carboxyl group, a sulfo group, a cyano group, a halogen atom (e.g., fluorine, chlorine, bromine), a hydroxyl group, an alkoxycarbonyl group (preferably having 8 or less carbon atoms, e.g., methoxycarbonyl, ethoxycarbonyl, benzyloxycarbonyl), an alkoxy group (preferably having 7 or less carbon atoms, e.g., methoxy, ethoxy, propoxy, butoxy, benzyloxy), an aryloxy group (e.g., phenoxy, p-tolyloxy), an acyloxy group (preferably having 3 or lees carbon atoms, e.g., acetyloxy, propionyloxy), an acyl group (preferably having 8 or less carbon atoms, e.g., acetyl, propionyl, benzoyl, mesyl), a carbamoyl group (e.g., unsubstituted carbamoyl, N,N-dimethylcarbamoyl, morpholinocarbamoyl, piperidinocarbamoyl), a. sulfamoyl group (e.g., unsubstituted sulfamoyl, N,N-dimethylsulfamoyl, morpholinosulfonyl), and an aryl group (e.g., phenyl, p-hydroxyphenyl, p-carboxyphenyl, p-sulfophenyl, α-naphthyl). The substituted alkyl group preferably has 6 or less carbon atoms.

Examples of substituents for the substituted methine group represented by $L_1$ or $L_2$ are a lower alkyl group (e.g., methyl, ethyl, propyl), a phenyl group, and a benzyl group.

The sensitizing dyes to be used in the present invention can easily be produced by those skilled in the art, by referring to the disclosures of U.S. Pat. No. 2,503,776, British Patent 742,112, French Patent 2,065,662 and JP-B-40-2346.

Specific examples of sensitizing dyes which can be used in the present invention are mentioned below, which, however, do not whatsoever restrict the scope of the present invention.

S-1

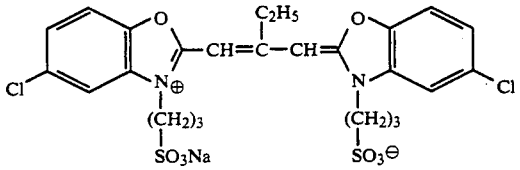

S-2

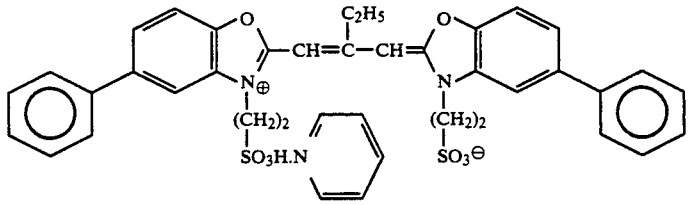

S-3

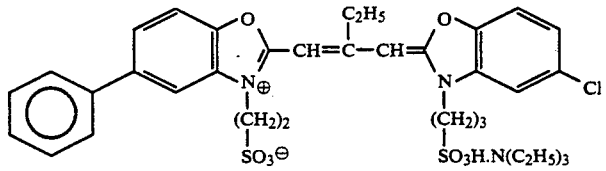

S-4

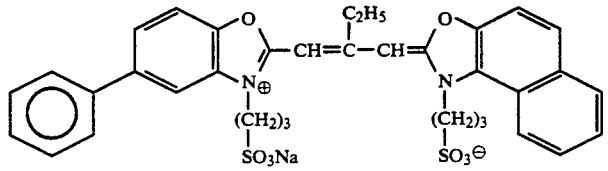

-continued
S-5
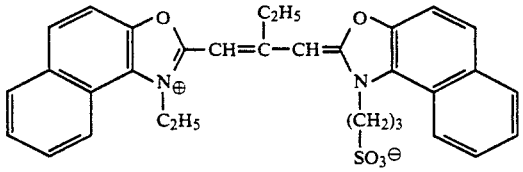
S-6
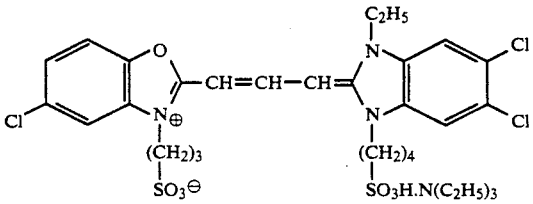
S-7
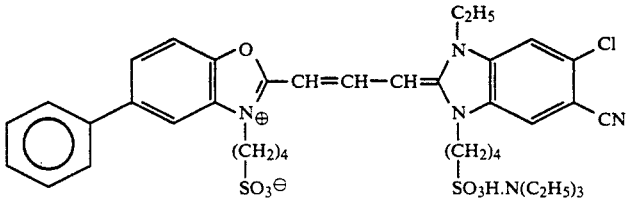
S-8
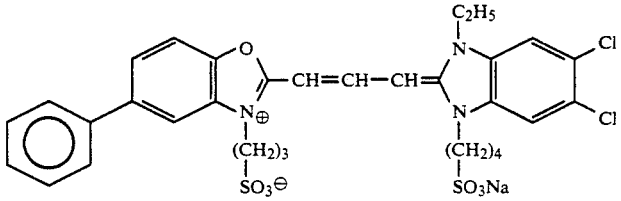
S-9
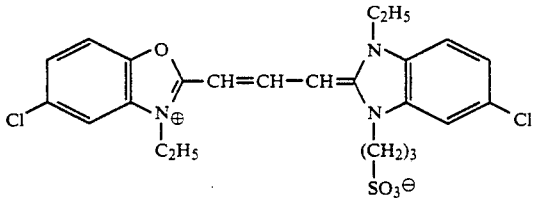
S-10
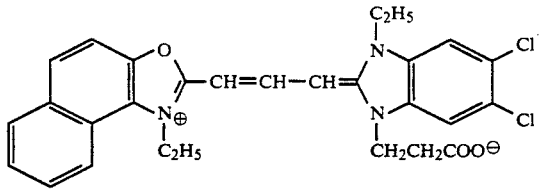
S-11
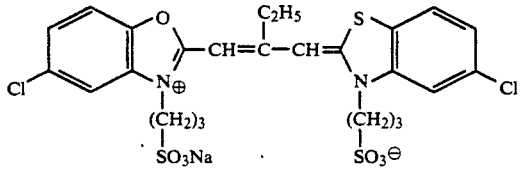
S-12
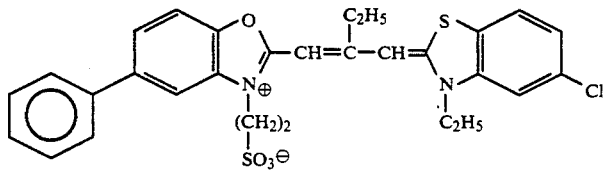

-continued
S-13
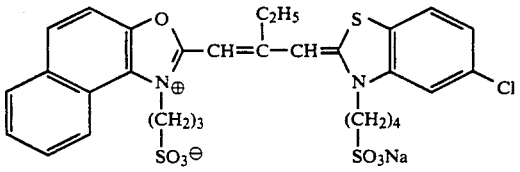
S-14
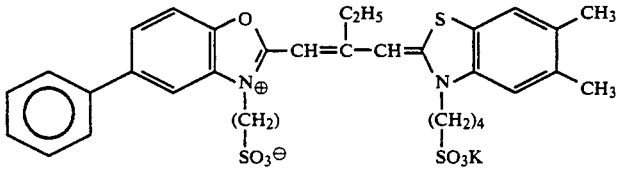
S-15
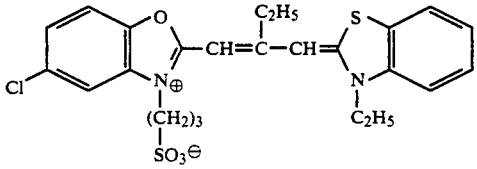
S-16
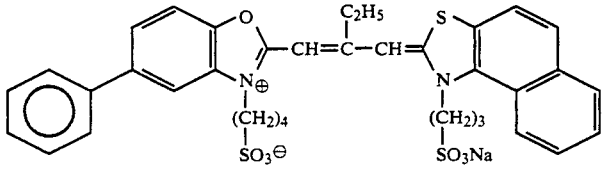
S-17
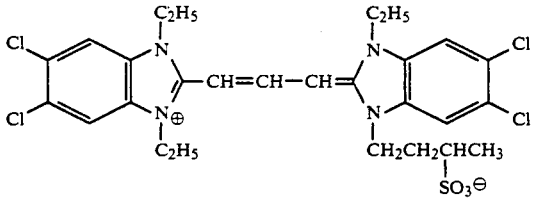
S-18
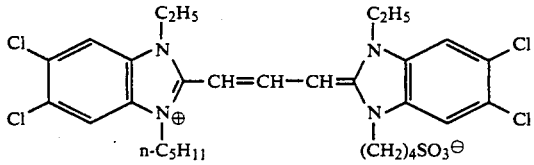
S-19
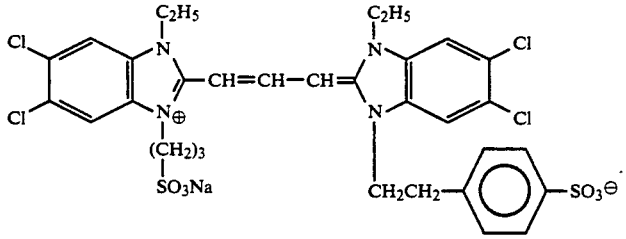
S-20
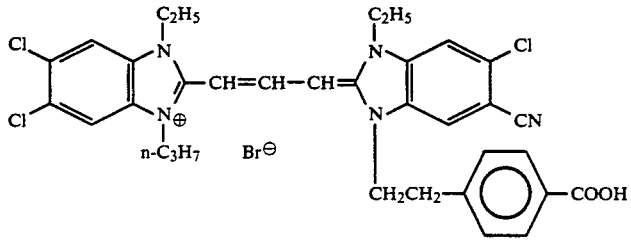

-continued
S-21
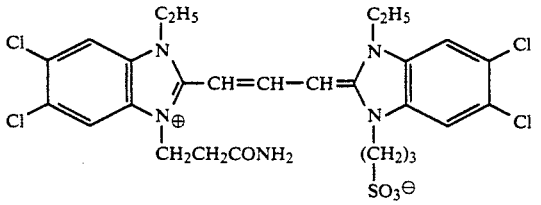
S-22
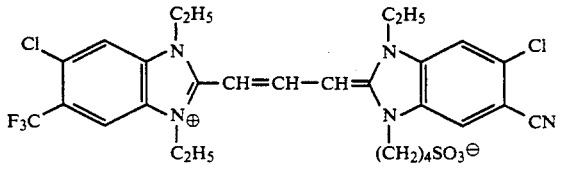
S-23
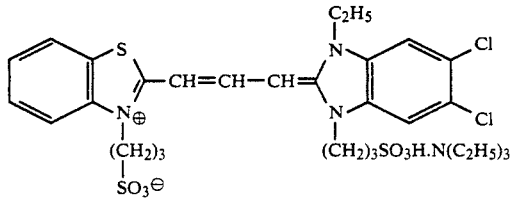
S-24
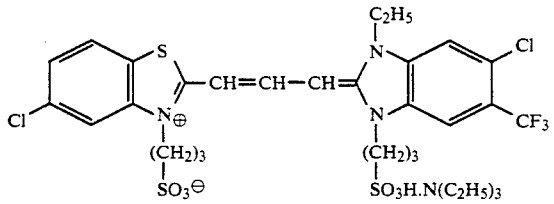
S-25
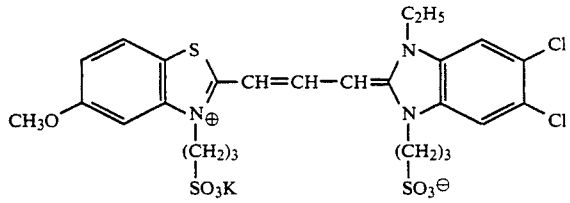
S-26
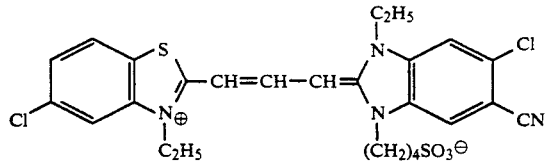
S-27
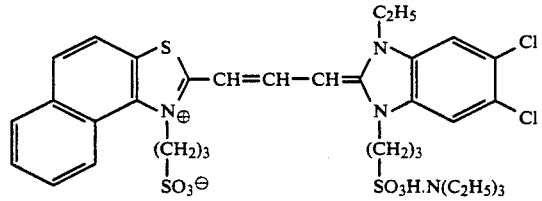
S-28
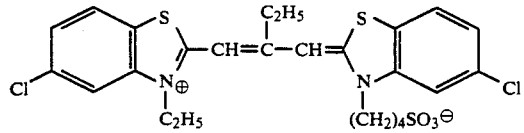

-continued
S-29
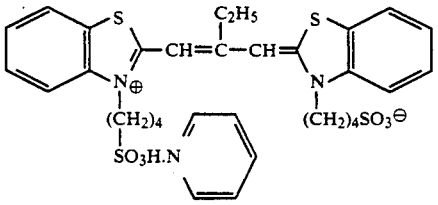
S-30
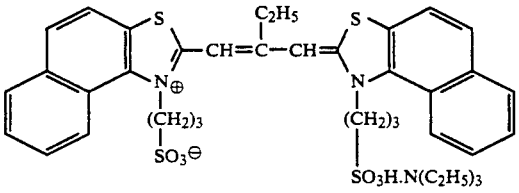
S-31
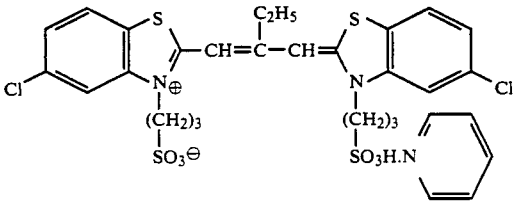
S-32
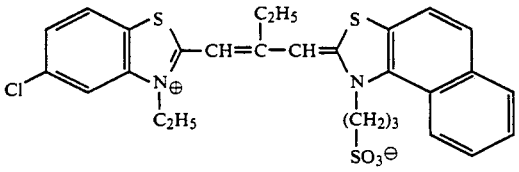
S-33
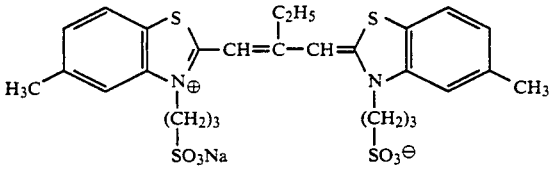
S-34
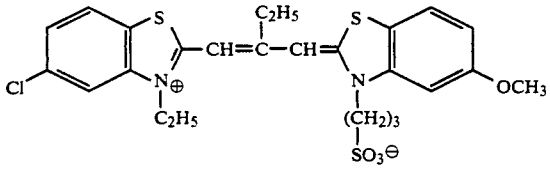
S-35
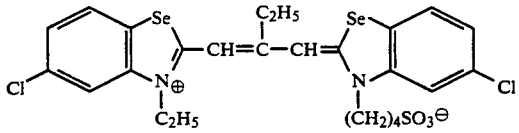
S-36
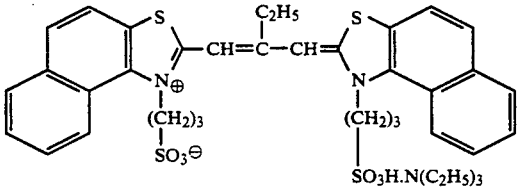
The above-described sensitizing dye is incorporated into the silver halide photographic emulsion of the photographic material processed by the method of the present invention, in an amount of from $5\times10^{-7}$ mol to $5\times10^{-2}$ mol, preferably from $1\times10^{-6}$ mol to $1\times10^{-3}$ mol, especially preferably from $2\times10^{-6}$ mol to $5\times10^{-4}$ mol, per mol of the silver halide in the emulsion.

The sensitizing dye may be directly dispersed in the emulsion layer. Alternatively, the dye may be first dissolved in an appropriate solvent, for example, methyl alcohol, ethyl alcohol, methyl cellosolve, acetone, water, pyridine or a mixed solvent comprising two or more of these solvents, and the resulting solution may be added to the emulsion.

In addition to the above-mentioned sensitizing dye, other sensitizing dyes may also be added to the emulsion in combination with the above sensitizing dye.

Where the photographic material is color-developed in the presence of a nucleating agent in accordance with the present invention, a nucleating agent of the following general formula (N-1) is preferably used.

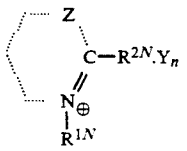

(N-1)

In the formula, Z represents a non-metallic atomic group necessary for forming a 5-membered or 6-membered hetero ring, and this may optionally be substituted. $R^{1N}$ represents an aliphatic group; $R^{2N}$ represents a hydrogen atom, an aliphatic group or an aromatic group; and $R^{1N}$ and $R^{2N}$ may optionally be substituted. Additionally, $R^{2N}$ may be bonded to the hetero ring completed by Z to form a ring. However, at least one of $R^{1N}$, $R^{2N}$ and Z must contain an alkynyl group, an acyl group, a hydrazine group or a hydrazone group; or $R^{1N}$ and $R^{2N}$ forms a 6-membered ring to complete a dihydropyridinium skeleton. Further, at least one substituent on the groups $R^{1N}$, $R^{2N}$ and Z may contain a silver halide adsorption-accelerating group. Y represents a pair ion for charge balance; and n represents 0 or 1.

More precisely, the hetero ring completed by Z includes, for example, quinoxalinium, benzothiazolium, benzimidazolium, pyridinium, thiazolinium, thiazolium, naphthothiazolium, selenazolium, benzoselenazolium imidazolium, tetrazolium, indolenium, pyrrolinium, acridinium, phenanthridinium, isoquinolinium, oxazolium, naphthoxazolium and benzoxazolium nuclei. Examples of substituents which may be in the group Z, are a $C_{1-8}$ alkyl group, a $C_{2-10}$ alkenyl group, a $C_{7-16}$ aralkyl group, a $C_{6-15}$ aryl group, a $C_{2-10}$ alkynyl group, a hydroxyl group, a $C_{1-8}$ alkoxy group, a $C_{6-15}$ aryloxy group, a halogen atom, a $C_{0-16}$ amino group, a $C_{1-8}$ alkylthio group, a $C_{6-15}$ arylthio group, a $C_{1-9}$ acyloxy group, an $C_{1-9}$ acylamino group, a $C_{1-8}$ sulfonyl group, a $C_{1-8}$ sulfonyloxy group, a $C_{0-8}$ sulfonylamino group, a carboxyl group, a $C_{1-9}$ acyl group, a $C_{1-8}$ carbamoyl group, a $C_{0-8}$ sulfamoyl group, a sulfo group, a cyano group, a $C_{1-10}$ ureido group, a $C_{1-10}$ urethane group, a $C_{1-10}$ carbonate group, a $C_{0-10}$ hydrazine group, a $C_{0-10}$ hydrazone group and a $C_{0-10}$ imino group. Suitable substituent(s) present in the group Z include at least one selected from the above-mentioned substituents. Where the group Z has two or more substituents, the substituents may be the same or different. Additionally, the above-mentioned substituents may further be substituted by any of the above substituents.

Further, another example of the substituent present in the group Z include a heterocyclic quaternay ammonium group completed by Z via a appropriate linking group L. In this case, the compound is said to have a so-called dimer structure.

Examples of heterocyclic groups completed by the group Z are preferably quinolinium, benzothiazolium, benzimidazolium, pyridinium, acridinium, phenanthridinium and isoquinolinium nuclei. More preferred are quinolinium and benzothiazolium nuclei; and most preferred is a quinolinium nucleus.

The aliphatic group represented by $R^{1N}$ or $R^{2N}$ is preferably an unsubstituted alkyl group having from 1 to 18 carbon atoms, or a substituted alkyl group in which the alkyl moiety has from 1 to 18 carbon atoms. Examples of substituents present in the substituted alkyl group include the same substituents as described above for Z. Additionally, $R^{2N}$ may be bonded to the hetero ring completed by Z to form a ring.

The aromatic group represented by $R^{2N}$ is preferably one having from 6 to 20 carbon atoms, which includes, for example, a phenyl group and a naphthyl group. Examples of substituents in the aromatic group include the substituents for the group Z described above. Preferably, $R^{2N}$ is an aliphatic group; and most preferably, it is a methyl group, a substituted methyl group, or a group bonded to the hetero ring completed by the group Z to form a ring.

At least one of the groups $R^{1N}$, $R^{2N}$ and Z has an alkynyl group, an acyl group, a hydrazine group or a hydrazone group; or $R^{1N}$ and $R^{2N}$ form a 6-membered ring to complete a dihydropyridinium skeleton. These may optionally be substituted by substituents, for example, those as described above as substituents of the group Z.

In accordance with the present invention, preferred is the case where at least one of $R^{1N}$, $R^{2N}$ and Z or at least one of the substituents on the 6-membered ring formed by $R^{1N}$ and $R^{2N}$ is an alkynyl group or an acyl group, or the case where $R^{1N}$ and $R^{2N}$ are bonded to form a dihydropyridinium skeleton. More preferably, the compound contains at least one alkynyl group, most preferably at least one propargyl group.

A group of the formula $X^1$—$(L^1)_m$— is preferred, in which $X^1$ represents a silver halide adsorption-accelerating group, $L^1$ represents a divalent linking group, and m represents 0 or 1 as the silver halide adsorption-accelerating group which may be in the substituents of $R^{1N}$, $R^{2N}$ and Z.

Preferred examples of silver halide adsorption-accelerating groups represented by $X^1$ include a thioamido group, a mercapto group and a 5-membered or 6-membered heterocyclic group.

These groups may optionally be substituted by substituents, for example, those as described with respect to the substituents of the group Z. The thioamido group is preferably a non-cyclic thioamido group (for example, a thiourethane group or a thioureido group).

A heterocyclic mercapto group is especially preferred as the mercapto group represented by $X^1$ with examples, including 5-mercaptotetrazole, 3-mercapto-1,2,4-triazole, 2-mercapto-1,3,4-thiadiazole, and 2- mercapto-1,3,4-oxadiazole.

The 5-membered or 6-membered nitrogen-containing heterocyclic group as represented by $X^1$ is composed of nitrogen, oxygen, sulfur and carbon atoms. Preferably, it is to form an imino silver, for example, including a benzotriazole and an aminothiatriazole.

The divalent linking group as represented by $L^1$ is an atom or an atomic group containing at least one of C, N, S and O atoms. Specifically, examples include a $C_{1-10}$ alkylene group, a $C_{1-10}$ alkenylene group, a $C_{2-10}$ alkynylene group, a $C_{6-15}$ arylene group, —O—, —S—, —NH—, —N=, —CO— and —$SO_2$—, as well as a combination of two or more of these groups. The groups may optionally be substituted. Examples of preferred combinations of these groups are $$-\overset{O}{\overset{\|}{C}}-,\ -\overset{O}{\overset{\|}{C}}NH-,\ -SO_2NH-,\ -O\overset{O}{\overset{\|}{C}}NH-,$$

$$-NH\overset{O}{\overset{\|}{C}}NH-,\ -NHSO_2NH-,\ \text{-(alkylene)-}\overset{O}{\overset{\|}{C}}NH-,$$

$$\text{-(arylene)-}SO_2NH-,\ \text{-(arylene)-}NH\overset{O}{\overset{\|}{C}}NH-\text{and}$$

-continued $$\text{-(arylene)-}\overset{O}{\overset{\|}{C}}NH-.$$

Examples of the pair ion Y for charge balance are, for example, bromide ion, chloride ion, iodide ion, p-toluenesulfonate ion, ethylsulfonate ion, perchlorate ion, trifluoromethanesulfonate ion, thiocyan ion, boron tetrafluoride ion and phosphorus hexafluoride ion.

These compounds and methods of their prepariation are described, for example, in patent publications referred to in *Research Disclosure,* No. 22543 (issued on January, 1983, pages 50 to 54) and No. 23213 (issued on August, 1983, pages 267 to 270), as well as in JP-B-49-38164, JP-B-52-19452 and JP-B-52-47326, JP-A-52-69613, JP-A-52-3426, JP-A-55-138742 and JP-A-60-11827, and U.S. Pat. Nos. 4,306,016 and 4,471,044.

Specific examples of compounds of the above-described general formula (N-I) are described below, which, however, are not whatsoever restrict the scope of the present invention.

(N-I-1)

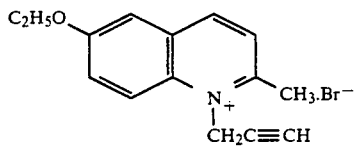

(N-I-2)

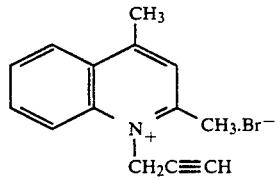

(N-I-3)

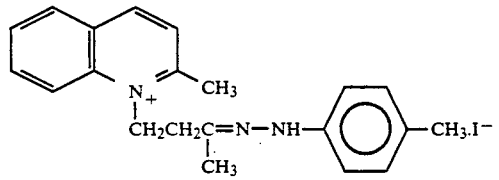

(N-I-4)

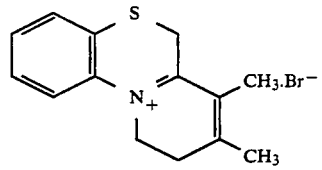

(N-I-5)

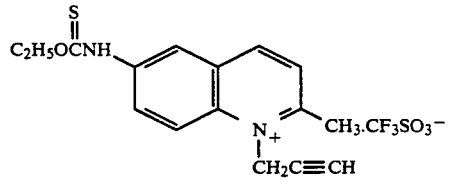

(N-I-6)

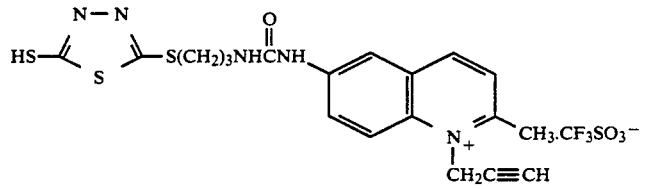

-continued
(N-I-7)
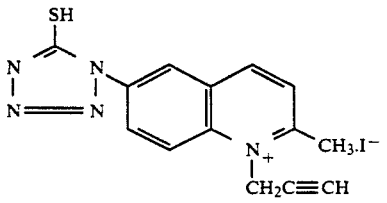
(N-I-8)
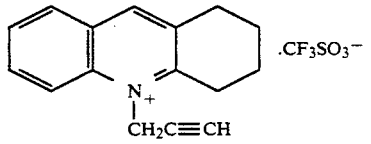
(N-I-9)
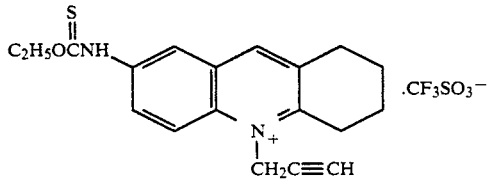
(N-I-10)
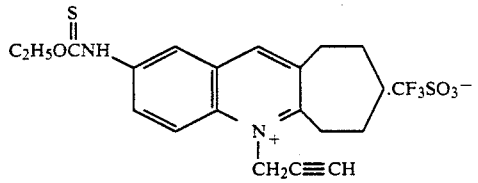
(N-I-11)
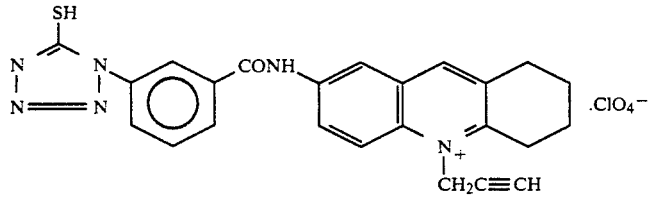
(N-I-12)
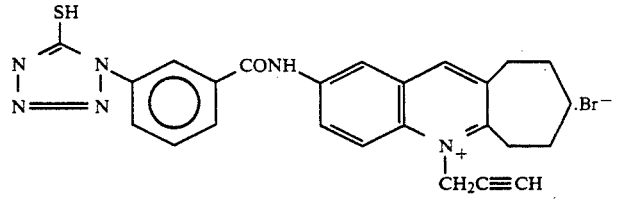
(N-I-13)
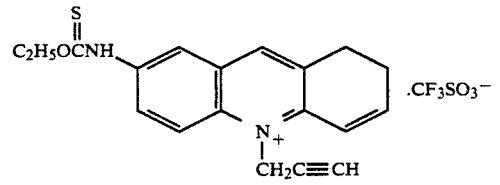
(N-I-14)
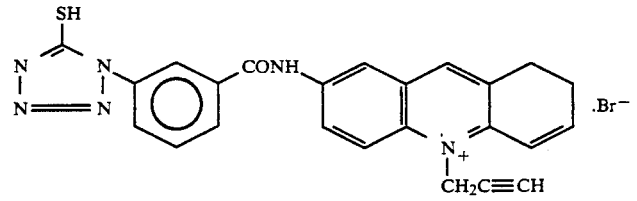

-continued (N-I-15)

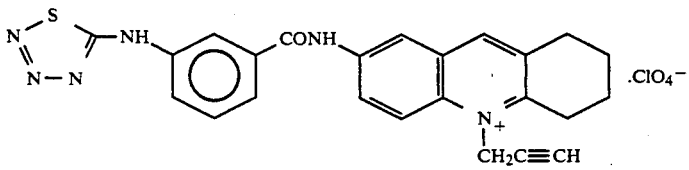

(N-I-16)

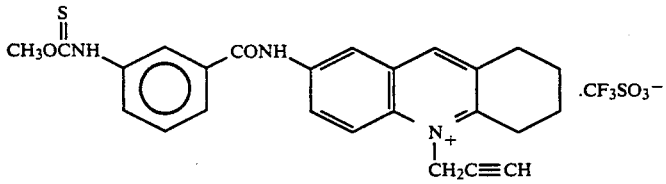

(N-I-17)

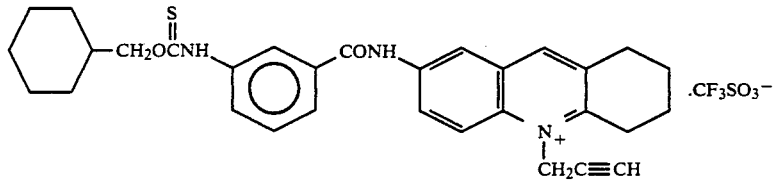

(N-I-18)

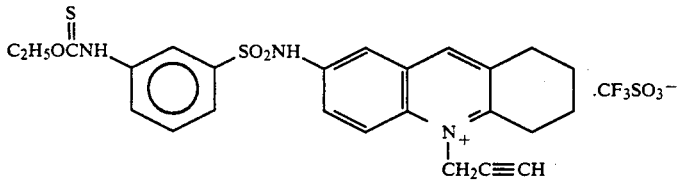

(N-I-19)

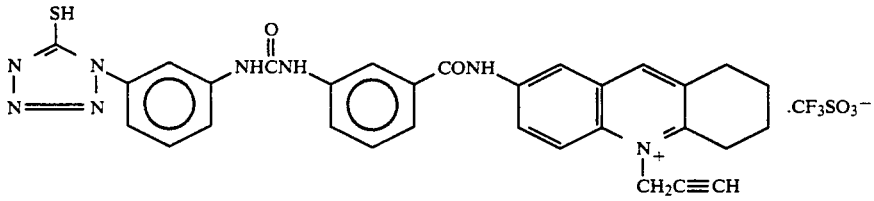

(N-I-20)

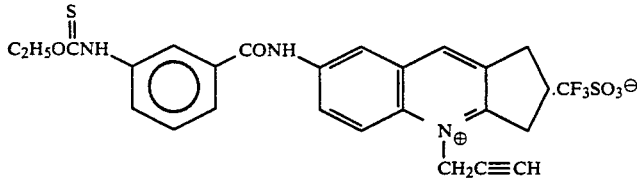

In accordance with the present invention, the compound of the formula (N-I) may be incorporated into the photographic material or into the processing solution to be used for processing the photographic material. Where the compound is present in the photographic material, the amount thereof is from $10^{-8}$ to $10^{-2}$ mol/mol of Ag, preferably from $10^{-7}$ to $10^{-3}$ mol/mol of Ag. Where the compound is in the processing solution, the amount thereof is from $10^{-5}$ to $10^{-1}$ mol/mol of Ag, preferably from $10^{-4}$ to $10^{-2}$ mol/mol of Ag.

The previously non-fogged internal latent image-type silver halide emulsion used in the present invention is an emulsion containing silver halide grains whose surfaces are not previously fogged and which form a latent image essentially in the inside of the grains. Specifically, the internal latent image-type silver halide emulsion for use in the present invention may be determined as follows. As silver halide emulsion to be determined is coated on a transparent support in a determined amount (from 0.5 to 3 g/m$^2$), this is exposed for a determined period of from 0.01 second to 10 seconds and then developed with the following developer (A) (internal developer) at 18° C. for 5 minutes, and the maximum density of the image formed is determined by conventional photographic densitometry. On the other hand, the same silver halide emulsion is coated on the same support in the same manner as above and then exposed also in the same manner as above. The thus exposed material is then developed with the following developer (B) (surface developer) at 20° C. for 6 minutes and the maximum density of the image formed is determined also in the same manner as above. When the value of the maximum density obtained in the former development (development with the internal developer (A)) is at least 5 times, more preferably at least 10 times, of that obtained in the latter development (development with the surface developer (B)), the emulsion tested is an internal latent image-type emulsion which is preferably employed in the present invention.

| | |
|---|---|
| Internal Developer (A): | |
| Metol | 2 g |
| Sodium Sulfite (Anhydride) | 90 g |
| Hydroquinone | 8 g |
| Sodium Carbonate (Monohydrate) | 52.5 g |
| KBr | 5 g |
| KI | 0.5 g |
| Water to make | 1 liter |
| Surface Developer (B): | |
| Metol | 2.5 g |
| L-Ascorbic Acid | 10 g |
| $NaBO_2.4H_2O$ | 35 g |
| KBr | 1 g |
| Water to make | 1 liter |

Examples of internal latent image-type emulsions which can be used in the present invention are the conversion-type silver halide emulsion described in U.S. Pat. No. 2,592,250, as well as core/shell type silver halide emulsions described in U.S. Pat. Nos. 3,761,276, 3,850,637, 3,923,513, 4,035,185, 4,395,478 and 4,504,570, JP-A-52-156614, JP-A-55-127549, JP-A-53-60222, JP-A-56-22681, JP-A-59-208540, JP-A-60-107641, JP-A-61-3137 and JP-A-62-215272, and *Research Disclosure,* No. 23510 (issued on November, 1983, page 236).

"Essentially (100) face tetradecahedral silver halide grains" as referred to herein indicate those in which 60% or more of the surface area of the grain is composed of (100) faces. The "silver halide emulsion containing cubic or essentially (100) face tetradecahedral silver halide grains", which is preferably used in the present invention, means that 50% by number of more, more preferably 80% by number or more, especially preferably 95% by number of more, of the grains in the emulsion (preferably, core/shell emulsion) are cubic or essentially (100) face tetradecahedral silver halide grains.

The proportion of (100) faces on the surface of the silver halide grain for use in the present invention may easily be obtained by applying a face-selective (or face-adsorbing) dye to the grain by adsorption followed by measuring the absorption spectrum of the dye-adsorbed grain using a spectrophotometer.

The spectrophotometric method used is described in detail in *Journal of Imaging Science,* 29, 165 (1985).

The composition of the silver halide in the emulsion of the present invention is preferably silver chloride, silver bromide or a mixed silver halide. Desirably, the silver halide for use in the present invention does not contain silver iodide, or if it contains silver iodide, it is silver chloro(iodo)bromide, silver (iodo)chloride or silver (iodo)bromide having a silver iodide content of 3 mol % or less. More preferably, silver bromide is employed in the present invention.

The mean grain size of the silver halide grains used in the present invention is preferably from 0.1 micron to 2 microns, especially preferably from 0.15 micron to 1 micron. The grain size distribution may be either narrow or broad. However, for the purpose of improving the graininess and sharpness, a so-called "monodispersed" silver halide emulsion having a narrow grain size distribution is preferably used in the present invention, in which 90% by weight or more of the total grains have a grain size falling within the range of the mean grain size plus/minus 40%, preferably 20%. In order that the photographic material has the intended gradation, two or more monodispersed silver halide emulsion each having a different grain size or plural silver halide grains each having the same size but having a different sensitivity may be combined in the same layer or may be present in different sub-layers, providing an emulsion layer having substantially the same color-sensitivity. Additionally, a combination of two or more polydispersed silver halide emulsions or a combination of a monodispersed emulsion and a polydispersed emulsion may be employed in the form of a layer containing them or in the form of separate sublayers.

The silver halide emulsion for use in the present invention may be chemically sensitized in the inside of the silver halide grain or on the surface thereof, by sulfur or selenium sensitization, reduction sensitization or noble metal sensitization or a combination of such sensitizations. The details of suitable sensitization means are described, for example, in patent publications as referred to in *Research Disclosure,* No. 17643-III (issued on December, 1978, page 23).

The photographic emulsion used in the present invention is color-sensitized using photographic sensitizing dyes by conventional methods. Especially useful dyes are cyanine dyes, merocyanine dyes and complex merocyanine dyes, and these can be used alone or in combination. Additionally, the dyes may be combined with super color sensitizers. The details of these dyes are described, for example, in patent publications as referred to in *Research Disclosure,* No. 17643-IV (issued on December, 1978, pages 23 to 24).

The photographic emulsion for use in the present invention may contain an antifoggant or stabilizer, for the purpose of preventing fog during preparation, storage or photographic processing of the photographic material or for the purpose of stabilizing the photographic properties of the material. The details of antifoggants and stabilizers usable for the purposes are described, for example, in *Research Disclosure,* No. 17643-VI (issued on December, 1978) and E.J. Birr, *Stabilization of Photographic Silver Halide Emulsion* (published by Focal Press, 1974).

In forming a direct positive color image in accordance with the present invention, various color couplers are used. Color couplers which can be used are compounds which react with the oxidation product of an aromatic primary amine color developing agent in a coupling reaction to form or release a substantially non-diffusible dye, and are preferably those which are substantially non-diffusible by themselves. Typical examples of suitable color couplers are naphthol or phenol compounds, pyrazolone or pyrazoloazole compounds, and ring-opened or heterocyclic ketomethylene compound. Specific examples of cyan, magenta and yellow couplers which are suitable for the present invention are described in *Research Disclosure,* No. 17643 (issued on December, 1978, page 25, Item VII-D), ibid., No. 18717 (issued on November, 1979) and JP-A-62-215272, as well as in the patent publications as referred to therein.

Additionally, colored couplers for corecting the unnecessary absorption of the dyes formed in a short wavelength range, couplers forming color dyes having an appropriate diffusibility, non-coloring couplers, DIR couplers releasing a development inhibitor in the coupling reaction, and polymerized couplers may also be used.

Gelatin is advantageously used, as the binder or protective colloid in the emulsion layer or interlayer of the photographic material to be processed in accordance with the present invention, but any other hydrophilic colloid may also be used.

The photographic material processed by the present invention can contain a color-fogging inhibitor or a color-mixing inhibitor. Examples of such inhibitors are described, for example, in JP-A-62-215272, pages 185 to 193.

A color enhancer may be used in the present invention for the purpose of improving the coloring properties of the couplers used. Examples of suitable color enhancer compounds are described, for example, in JP-A-62-215272, pages 121 to 125.

The photographic material to be processed in the present invention may contain an anti-irradiation or anti-halation dye, an ultraviolet absorbent, a plasticizer, a brightening agent, a mat agent, an anti-foggant, a coating aid, a hardening agent, an antistatic agent and a slide property-improving agent. Examples of such additives are described in *Research Disclosure,* No. 17643, Item VIII to XIII (issued on December, 1978, pages 25 to 27) and ibid., No. 18716 (issued on November, 1979, pages 647 to 651).

The present invention is applicable to a multi-layer multi-color photographic material having at least two different color-sensitive layers on a support. A multi-layer natural color photographic material generally has at least one red-sensitive silver halide emulsion, at least one green-sensitive silver halide emulsion and at least one blue-sensitive silver halide emulsion on a support. The order of these layers on the support may varied as desired. Preferred examples of the order of forming the layers on the support are a red-sensitive layer, a green-sensitive layer and a blue-sensitive layer coated on a support in this order, or a green-sensitive layer, a red-sensitive layer and a blue-sensitive layer coated on a support in this order. The emulsion layer may be composed of two or more sub-layers each having a different degree of sensitivity. Alternatively, a non-light-sensitive layer may be provided between two or more emulsion layers each having the same color-sensitivity. In general, a red-sensitive emulsion layer contains a cyan-forming coupler, a green-sensitive emulsion layer contains a magenta-forming coupler, and a blue-sensitive emulsion layer contains an yellow-forming coupler. Other different combinations may also be employed as desired.

The photographic material to be processed by the present invention preferably contains, in addition to the above-mentioned silver halide emulsions, other various auxiliary layers such as a protective layer, an interlayer, a filter layer, an anti-halation layer, a backing layer and a white reflecting layer.

In preparing the photographic material to be processed by the present invention, the photographic emulsion layers and other layers are coated on various supports, for example, those described in *Research Disclosure,* No. 17643, Items V to VII (issued on December, 1978) or in European Patent 0102253. The coating methods described in *Research Disclosure,* No. 17643, Item XV, pages 28 to 29 can be utilized in coating the layers.

The present invention is applicable to various color photographic materials.

For instance, the present invention is applicable to color reversal films for slides or televisions, color reversal papers, or instant color films, as typical examples. Additionally, the present invention is applicable to color hard copies for storing images in full-color duplicators or CRT. Moreover, the present invention is applicable to black-and-white photographic materials for three coupler-blending, for example, those described in *Research Disclosure,* No. 17123 (issued on July, 1978).

In accordance with the present invention, various nucleation accelerators, for examples, those described below can be used for the purpose of further accelerating the action of the above-described nucleating agent.

More specifically, tetrazaindenes, triazaindenes and pentazaindes, which have at least one mercapto group optionally substituted by an alkali metal atom or ammonium group, as well as the compounds described in JP-A-63-106656 (pages 6 to 16) can be used as a nucleation accelerator.

Specific examples of suitable nucleation accelerators are mentioned below, which, however, do not whatsoever restrict the scope of the present invention.

(A-1): 3-Mercapto-1,2,4-triazolo[4,5-a]pyridine
(A-2): 3-Mercapto-1,2,4-triazolo[4,5-a]pyrimidine
(A-3): 5-Mercapto-1,2,4-triazolo[4,5-a]pyrimidine
(A-4): 7-(2-Dimethylaminoethyl)-5-mercapto-1,2,4-triazolo[1,5-a]pyrimidine
(A-5): 3-Mercapto-7-methyl-1,2,4-triazolo[4,5-a]pyrimidine
(A-6): 3,6-Dimercapto-1,2,4-triazolo[4,5-a]pyridazine
(A-7): 2-Mercapto-5-methylthio-1,3,4-thiadiazole
(A-8): 3-Mercapto-4-methyl1,2,4-triazole
(A-9): 2-(3-Dimethylaminopropylthio)-5-mercapto-1,3,4-thiadiazole Hydrochloride
(A-10): 2-(2-Morpholinoethylthio)-5-mercapto-1,3,4-thiadiazole Hydrochloride The nucleation accelerator may be incorporated into the photographic material or into the processing solution. Preferably, however, thus accelerator is incorporated into the photographic material, especially into the internal latent image-type silver halide emulsion layer or other hydrophilic colloid layers (e.g., interlayer or protective layer). Especially preferably, it is incorporated into the silver halide emulsion layer and layers adjacent thereto.

The amount of the nucleation accelerator used in the present invention is from $10^{-6}$ to $10^{-2}$ mol/mol of Ag, preferably from $10^{-5}$ to $10^{-2}$ mol/mol of Ag, in the photographic material.

The color developer which can be used for color-development of the photographic material of the present invention is preferably an alkaline aqueous solution consisting essentially of an aromatic primary amine color-developing agent. Examples of color-developing agents which can be used in the developer are preferably p-phenylenediamine compounds, although aminophenol compounds may also be used. Specific examples of compounds suitable as color-developing agents are 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides and p-toluenesulfonates. These compounds may be used alone or as a combination of two or more of them, if desired.

The color developer to be used in the present invention has a pH value of from 9 to 12, preferably from 9.5 to 11.5.

After color-development, the photographic emulsion layer is generally bleached. Bleaching may be effected silultaneously with fixation (bleach-fixation) or may be effected separately from fixation. In order to speed up the processing, bleaching may be followed by bleach-fixation. Additionally, use of two continuous two bleach-fixation baths, fixation before bleach-fixation, or bleach-fixation followed by bleaching may also be conducted, if desired in accordance with the object.

The silver halide color photographic material processed in accordance with the present invention is generally rinsed in water and/or stabilized and fixed, after desilvering. The amount of water to be used in the rinsing step may vary over a broad range, in accordance with the characteristics of the photographic material being processed (for example, couplers and other raw materials present in the photographic material), the use of the material, as well as the temperature of the rinsing water, the number of rinsing tanks (the number of rinsing stages), the rinsing system involving normal current or countercurrent replenishment, and other various conditions. For instance, the relationship between the number of rinsing tanks and the amount of rinsing water used in a multistage countercurrent rinsing system may be obtained from the method described in *Journal of the Society of Motion Picture and Television Engineers,* Vol. 64, pages 248 to 253 (May, 1955).

The silver halide color photographic material to be processed by the method of the present invention can contain a color-developing agent for the purpose of simplifying and promoting the processing of the material. Desirably, various precursors of color-developing agents are employed, in incorporating the agent into the photographic material.

The present invention is explained in greater detail by way of the following examples, which, however, are not intended to restrict the scope of the present invention. The compounds used in the examples are mentioned in Example 4. Unless otherwise indicated, all parts, percentages, ratios and the like are "by weight".

EXAMPLE 1

Preparation of Emulsion (1-1)

An aqueous solution of potassium bromide and an aqueous solution of silver nitrate were simultaneously added to an aqueous gelatin solution containing 0.3 g/mol-Ag of 3,4-dimethyl-1,3-thiazoline-2-thione with vigorous stirring at 75° C. over a period of about 20 minutes, whereupon the potential was kept constantly at +10 mV. Accordingly, a monodispersed silver bromide emulsion of tetradecahedral grains having a mean grain size of about 0.40 micron was obtained. The emulsion was then chemically sensitized, by adding 6 mg/mol-Ag of sodium thiosulfate and 7 mg/mol-Ag of chloroauric acid (tetrahydrate) thereto followed by heating the resulting emulsion at 75° C. for 80 minutes. The thus obtained core silver bromide grains were further grown under the same precipitation conditions as the first stage, and finally a monodispersed core/shell silver bromide emulsion of tetradecahedral grains having a mean grain size of about 0.7 micron was obtained. The coefficient of variation of the grain size of the emulsion was about 10%.

The emulsion was then chemically sensitized, by adding 1.5 mg/mol-Ag of sodium thiosulfate and 1.5 mg/mol-Ag of chloroauric .acid (tetrahydrate) thereto followed by heating the resulting emulsion at 60° C. for 60 minutes. Accordingly, an internal latent image-type silver halide emulsion (Emulsion 1-1) was obtained.

Using the thus prepared Emulsion (1-1), the following photographic material sample was prepared.

A paper support both surfaces of which were laminated with polyethylene (thickness: 100 microns) was used, and the surface to be coated with photographic layers contained a white pigment of titanium white.

Composition of Photographic Layer:

The components of the photographic layer to be coated on the support are described below and the amount coated is represented by g/m$^2$. The amount of silver halide coated indicates the amount of silver therein.

| | |
|---|---|
| First Layer: Red Sensitive Emulsion Layer | |
| Emulsion (1-1) color-sensitized with Red-Sensitizing Dyes (S-36, 31, 16) | 0.30 |
| Gelatin | 2.00 |
| Cyan Coupler (ExC-1) | 0.35 |
| Cyan Coupler (ExC-2) | 0.35 |
| Anti-Fading Agent (Cpd-1, 2, 3, 4; 1/1/1/1) | 0.30 |
| Coupler Dispersing Agent (Cpd-6) | 0.60 |
| Coupler Solvent (Solv-1, 2, 3; 1/1/1) | 0.20 |
| Second Layer: Protective Layer | |
| Acryl-Modified Copolymer of Polyvinyl Alcohol (modification degree 17%) | 0.04 |
| Polymethyl Methacrylate Grains (mean grain size 2.4 microns), silicon oxide (mean grain size 5 microns) (1/1 mixture) | 0.10 |
| Gelatin | 3.00 |
| Gelating Hardening Agent (H-1) | 0.34 |

The first layer further contained Nucleating Agent N-1-16 in an amount of $5\times10^{-7}$ mol per mol of silver halide and Nucleation Accelerator Cpd-22 in an amount of $10^{-2}$% by weight to the coated amount of silver halide. Additionally, both layes contained Alkanol XC (manufactured by DuPont) and sodium alkylbenzenesulfonate as emulsification and dispersion aids and succinate and Magefac F-12 (manufactured by Dainippon Ink) as coating aids. The first layer contained a stabilizer (Cpd-23, 24, 25). The photographic material sample thus prepared was designated Sample No. 101.

Other Samples Nos. 102 to 105 were prepared in the same manner as in preparation of Sample No. 101, except that $8\times10^{-3}$ mol/mol-Ag of Compound (8), (11), (22) or (24) of the present invention was added to the first layer (red-sensitive layer), respectively.

Next, green-sensitive photographic material samples (Samples No. 106 to 110) and blue-sensitive photographic material samples (Samples Nos. 111 to 115) were also prepared in the same manner as above, except that the red-sensitive emulsion layer was replaced by the following green-sensitive emulsion layer or blue-sensitive emulsion layer, respectively.

| Green-Sensitive Emulsion Layer of Samples Nos. 106 to 110: | |
|---|---|
| First Layer: Green-Sensitive Emulsion Layer | |
| Emulsion (1-1) color-sensitized with Green-Sensitizing Dye (S-2) | 0.30 |
| Gelatin | 0.80 |
| Magenta Coupler (ExM-1, 2, 3; 1/1/1) | 0.33 |
| Anti-Fading Agent (Cpd-9, 26; 1/1) | 0.45 |
| Stain Inhibitor (Cod-10, 11, 12, 13; 10/7/7/1) | 0.075 |
| Coupler Solvent (Solv-6) | 0.15 |
| Coupler Solvent (Solv-4, 6; 1/1) | 0.45 |
| Blue-Sensitive Emulsion Layer used in Samples Nos. 111 to 115: | |

-continued

| First Layer: Blue-Sensitive Emulsion Layer | |
|---|---|
| Emulsion (1-1) color-sensitized with Blue-Sensitizing Dye (ExS-5, 6) | 0.38 |
| Gelatin | 1.2 |
| Yellow Coupler (ExY-1, 2; of 1/1) | 0.8 |
| Anti-Fading Agent (Cpd-14) | 0.3 |
| Stain Inhibitor (Cpd-5, 15; 1/5) | 0.018 |
| Coupler Dispersing Agent (Cpd-6) | 0.13 |
| Coupler Solvent (Solv-2) | 0.3 |

Each of the thus prepared samples was wedgewise exposed (1/10 sec, 20 CMS) through a red filter (Samples 101-105), a green filter (Samples 106-110) or a blue filter (Samples 111-115) and then developed in accordance with the processing procedure mentioned below.

| Processing Steps | Processing Step: Time | Temperature |
|---|---|---|
| Color Development | 135 sec | 38° C. |
| Bleach-Fixation | 40 sec | 33° C. |
| Rinsing (1) | 40 sec | 33° C. |
| Rinsing (2) | 40 sec | 33° C. |
| Drying | 30 sec | 80° C. |

Processing solutions used in the above-mentioned steps were as follows:

| | Mother Solution |
|---|---|
| Color Developer: | |
| D-Sorbitol | 0.15 g |
| Sodium Naphthalenesulfonate/ Formaldehyde Condensate. | 0.15 g |
| Ethylenediaminetetrakismethylenephosphonic Acid | 1.5 g |
| Diethylene Glycol | 12.0 ml |
| Benzyl Alcohol | 13.5 ml |
| Potassium Bromide | 0.80 g |
| Benzotriazole | 0.003 g |
| Sodium Sulfite | 2.4 g |
| N,N-bis(Carboxymethyl)hydrazine | 6.0 g |
| D-Glucose | 2.0 g |
| Triethanolamine | 6.0 g |
| N-Ethyl-N-(β-methanesulfonamidoethyl)-3-methyl-4-aminoaniline Sulfate | 6.4 g |
| Potassium Carbonate | 30.0 g |
| Brightening Agent (diaminostilbene type) | 1.0 g |
| Water to make | 1000 ml |
| pH (25° C.) | 10.25 |
| Bleach-Fixing Solution: | |
| Disodium Ethylenediaminetetraacetate Dihydrate | 4.0 g |
| Ammonium Ethylenediaminetetraacetate/Fe(III) Complex Dihydrate | 70.0 g |
| Ammonium Thiosulfate (700 g/liter) | 180 ml |
| Sodium p-Toluenesulfinate | 20.0 g |
| Sodium Bisulfite | 20.0 g |
| 5-Mercapto-1,3,4-triazole | 0.5 g |
| Ammonium Nitrate | 10.0 g |
| Water to make | 1000 ml |
| pH (25° C.) | 6.20 |

Rinsing Water:

City water was passed through a mixed bed column filled with an H-type strong acidic cation-exchange resin (Amberlite IR-120B, manufactured by Rhom & Haas Co.) and on OH-type anion-exchange resin (Amberlite IR-400, manufactured by Rhom & Haas Co.) whereby both the calcium ion concentration and the magnesium ion concentration were lowered to 3 mg/liter or less, and subsequently 20 mg/liter of sodium dichloroisocyanurate and 1.5 g/liter of sodium nitrate were added thereto. The thus treated solution had a pH value within the range of from 6.5 to 7.5.

The cyan, magenta or yellow color density of the thus obtained direct positive image in each sample was measured.

On the other hand, all the samples were aged at conditions of 60° C. and 55% RH for 3 days and then subjected to the same exposure and processing as above. The color density of each of the processed samples was also measured.

The results obtained are shown in Table 1 below.

TABLE 1

| Sample No. | Compound in First Layer | Before Aging $D_{max}$ | Before Aging $D_{min}$ | After Aging at 60° C. and 55% RH for 3 days $D_{max}$ | After Aging at 60° C. and 55% RH for 3 days $D_{min}$ |
|---|---|---|---|---|---|
| 101 (Comparison) | No | 2.05 | 0.20 | 1.78 | 0.31 |
| 102 (The Invention) | 8 | 2.10 | 0.16 | 1.90 | 0.17 |
| 103 (The Invention) | 11 | 2.05 | 0.15 | 2.02 | 0.18 |
| 104 (The Invention) | 22 | 2.10 | 0.13 | 1.92 | 0.15 |
| 105 (The Invention) | 24 | 2.13 | 0.14 | 1.80 | 0.17 |
| 106 (Comparison) | No | 2.20 | 0.25 | 1.80 | 0.38 |
| 107 (The Invention) | 8 | 2.20 | 0.22 | 1.83 | 0.34 |
| 108 (The Invention) | 11 | 2.21 | 0.20 | 1.85 | 0.35 |
| 109 (The Invention) | 22 | 2.25 | 0.21 | 1.82 | 0.32 |
| 110 (The Invention) | 24 | 2.23 | 0.20 | 1.83 | 0.34 |
| 111 (Comparison) | No | 1.90 | 0.18 | 1.82 | 0.25 |
| 112 (The Invention) | 8 | 1.95 | 0.16 | 1.80 | 0.23 |
| 113 (The Invention) | 11 | 1.90 | 0.17 | 1.81 | 0.21 |
| 114 (The Invention) | 22 | 1.91 | 0.16 | 1.83 | 0.20 |
| 115 (The Invention) | 24 | 1.93 | 0.16 | 1.80 | 0.27 |

From the data in Table 1, it can be seen that the samples of the present invention gave favorable results where the minimum image density ($D_{min}$) was lowered while the maximum image density ($D_{max}$) was high. Additionally, in the aged samples of the present invention, the decrease of the maximum image density ($D_{max}$) and the increase of the minimum image density ($D_{min}$) were both small. That is, the photographic characteristics of the samples of the present invention deteriorate little during storage.

EXAMPLE 2

Preparation of Emulsions (2-1) to (2-5)

Emulsion (2-1) was prepared in the same manner as in preparation of Emulsion (1-1) in Example 1, except that a red-sensitive dye (S-31) was added after chemical sensitization at 60° C. for 60 minutes and thereafter the emulsion was heated at 20° C. for 20 minutes and then cooled.

Further, other Emulsions (2-2) to (2-7) were prepared in the same manner as in the preparation of Emulsion (2-1), except that Compound (8), (11), (22) or (24) of the present invention was added along with the red-sensitizing dye (S-31), respectively, as indicated in Table 2 below, and thereafter the emulsion was heated at 60° C. for 20 minutes.

Using the thus prepared Emulsions (2-1) to (2-7), photographic material samples (Samples Nos. 201 to 207) were prepared in the same manner as in Example 1. Sample No. 101 (as prepared in Example 1) and Samples Nos. 201 to 207 were subjected to the following Test-1 and Test-2.

Test-1:

Each sample was wedgewise exposed through a red filter and developed and the cyan color density was measured, in the same manner as in Example 1. Accordingly, a characteristic curve was obtained for each sample. In order to check the gradation in the highlight areas, in addition to Dmax and Dmin, the value of ΔlogE between the two points of D=0.8 and D=0.2 was obtained ($\overline{G}_{0.8/0.2}$).

Test-2:

The reflection spectrum of each of Samples (2-1) to (2-7) and (1-1) was measured, and the value $\lambda_{max}$ of reflection spectrum and the half value width thereof were obtained. The peak position and the half value width of reflection spectrum corresponded to the motion of the spectral sensitivity of each sample.

The results of Test-1 and Test-2 are shown in Table 2 below.

TABLE 2

| Sample No. | Emulsion Used | Compound of Condition-1 Used: Kind | Compound of Condition-1 Used: Amount (mol/mol-Ag) | Characteristic Curve: $D_{max}$ | Characteristic Curve: $D_{min}$ | Characteristic Curve: $\underline{G}_{0.8/0.2}$ | Reflection Spectrum: $\lambda_{max}$ (nm) | Reflection Spectrum: Half Value Width (nm) |
|---|---|---|---|---|---|---|---|---|
| 101 (Comparison) | 1-1 | No | No | 2.08 | 0.21 | 0.25 | 645 | 40 |
| 201 (Comparison) | 2-1 | No | No | 1.85 | 0.35 | 0.35 | 658 | 20 |
| 202 (The Invention) | 2-2 | 8 | $8 \times 10^{-3}$ | 2.12 | 0.18 | 0.25 | 656 | 20 |
| 203 (The Invention) | 2-3 | 8 | $2 \times 10^{-2}$ | 2.08 | 0.15 | 0.23 | 650 | 25 |
| 204 (The Invention) | 2-4 | 11 | $5 \times 10^{-4}$ | 2.10 | 0.19 | 0.27 | 657 | 20 |
| 205 (The Invention) | 2-5 | 11 | $5 \times 10^{-3}$ | 2.13 | 0.17 | 0.23 | 655 | 23 |
| 206 (The Invention) | 2-6 | 22 | $8 \times 10^{-3}$ | 2.10 | 0.16 | 0.22 | 656 | 22 |
| 207 (The Invention) | 2-7 | 24 | $8 \times 10^{-3}$ | 2.12 | 0.15 | 0.24 | 654 | 21 |

The samples of the present invention gave favorable results, where the minimum image density ($D_{min}$) was lowered while the maximum image density ($D_{max}$) was high.

Additionally, since the color-sensitivity of the samples of the present invention was sharpened and separation of the color-sensitivity in the respective light-sensitive layer was improved, the color-reproducibility of the samples of the present invention was improved. In this connection, although the color-sensitivity of Sample (2-1) (comparative sample) was sharpened, the minimum image density ($D_{min}$) increased in Sample (2-1). That is, the comparative Sample (2-1) did not display the effect of the present invention.

EXAMPLE 3

Preparation of Emulsions (3-1) to (3-3)

An aqueous solution of potassium bromide and an aqueous solution of silver nitrate were simultaneously added to an aqueous gelatin solution with vigorous stirring at 65° C. over a period of about 40 minutes, whereupon the potential was kept at +50 mV. Accordingly, a monodispersed silver bromide emulsion of cubic grains having a mean grain size of 0.25 micron was obtained. The emulsion was then chemically sensitized, by adding 4 mg/mol-Ag of sodium thiosulfate and 4 mg/mol-Ag of chloroauric acid (tetrahydrate) thereto followed by heating the resulting emulsion at 75° C. for 60 minutes. The thus prepared core silver bromide grains were further grown for 40 minutes under the same precipitation conditions as the first stage, and finally a monodispersed core/shell silver bromide emulsion of cubic grains having a mean grain size of 0.60 micron was obtained. The coefficient of variation of the grain size of the emulsion was about 11%. The emulsion was then chemically sensitized, by adding 1.0 mg/mol-Ag of sodium thiosulfate and 1.5 mg/mol-Ag of chloroauric acid (tetrahydrate) thereto followed by heating the resulting emulsion at 60° C. for 60 minutes. Accordingly, an internal latent image-type silver bromide emulsion (Emulsion 3-1) was obtained.

The proportion of (100) faces on the outer surface of the grain was 95%, as calculated by the method described in the above-mentioned *Journal of Imaging Science*, 29, 165 (1985). The other faces of the grain were (111) faces.

Next, other silver bromide emulsions (Emulsion (3-2) and Emulsion (3-3)) were prepared in the same manner as above, except that the precpitation conditions (pAg) in preparing the emulsion was varied. The proportion of (100) faces in Emulsions (3-2) and (3-3) was 70% and 10%, respectively. The potential during formation of the grains in preparing Emulsions (3-2) and (3-3) was +30 mV and −10 mV, respectively.

Preparation of Emulsions (3-4) to (3-5)

A mixed aqueous solution containing potassium bromide and sodium chloride and an aqueous solution of silver nitrate were simultaneously added to an aqueous gelatin solution with vigorously stirring at 65° C. over a period of about 35 minutes, whereupon the potential was kept at +50 mV. Accordingly, a monodispersed silver chlorobromide emulsion of grains having a mean grain size of about 0.25 micron and having a silver bromide content of 80 mol %. The emulsion was then chemically sensitized, by adding 4 mg/mol-Ag of sodium thiosulfate and 4 mg/mol-Ag of chloroauric acid (tetrahydrate) thereto followed by heating the resulting emulsion at 75° C. for 60 minutes. The thus obtained core silver chlorobromide grains were further grown under the same precipitation conditions as the first stage, and finally a monodispersed core/shell silver chlorobromide emulsion of grains having a mean grain size of 0.60 micron and a silver bromide content of 80 mol % was obtained. The coefficient of variation of the grain size of the emulsion was about 12%. The emulsion was then chemically sensitized, by adding 1.0 mg/mol-Ag of sodium thiosulfate and 1.5 mg/mol-Ag of chloroauric acid (tetrahydrate) thereto followed by heating the resulting emulsion at 60° C. for 60 minutes. Accordingly, an internal latent image-type silver chlorobromide emulsion (Emulsion 3-4) was obtained.

The proportion of (100) faces on the outer surface of the grain was 70%. Next, another silver chlorobromide emulsion (Emulsion 3-5) having a (100) face proportion of 15% was prepared in the same manner as in preparation of Emulsion (3-4) except that the precipitation conditions (pAg) in preparing the emulsion was varied.

The halogen composition, the shape of the grains and the proportion of (100) faces to the total surface areas of the grains of all the thus prepared Emulsions (3-1) to (3-5) are shown in Table 3 below.

TABLE 3

| Emulsion | Halogen Composition | Shape of Grains | Proportion of (100) Faces to Total Surface Areas of Grains (%) |
|---|---|---|---|
| 3-1 | AgBr | Cubic | 95 |
| 3-2 | AgBr | Tetradecahedral | 70 |
| 3-3 | AgBr | Octahedral | 10 |
| 3-4 | $AgBr_{80}Cl_{20}$ | Tetradecahedral | 70 |
| 3-5 | $AgBr_{80}Cl_{20}$ | Octahedral | 15 |

Using Emulsions (3-1) to (3-5), Samples (301) to (313) were prepared in the same manner as in Example 1, whereupon the compound of condition-1 of the present invention (as indicated in Table 4 below) was added to the red-sensitive layer (First Layer). Samples (301) to (313) were subjected to Test-1 and Test-2 in the same manner as in Example 2. The composition of each sample and the results of the two tests are shown in Table 4 below.

TABLE 4

| Sample No. | Emulsion Used | Compound of Condition-1 Used: Kind | Compound of Condition-1 Used: Amount (mol/mol-Ag) | Characteristic Curve: $D_{max}$ | Characteristic Curve: $D_{min}$ | Characteristic Curve: $G_{0.8/0.2}$ | Reflection Spectrum: $\lambda_{max}$ (nm) | Reflection Spectrum: Half Value Width (nm) |
|---|---|---|---|---|---|---|---|---|
| 301 (Comparison) | 3-1 | No | — | 1.95 | 0.38 | 0.39 | 657 | 18 |
| 302 (The Invention) | " | 8 | $1.0 \times 10^{-2}$ | 2.30 | 0.17 | 0.21 | 657 | 18 |
| 303 (The Invention) | " | 21 | $1.0 \times 10^{-2}$ | 2.28 | 0.18 | 0.23 | 655 | 20 |
| 304 (Comparison) | 3-2 | No | — | 2.00 | 0.28 | 0.30 | 650 | 22 |
| 305 (The Invention) | " | 8 | $1.0 \times 10^{-2}$ | 2.30 | 0.18 | 0.24 | 648 | 25 |
| 306 (The Invention) | " | 21 | $1.0 \times 10^{-2}$ | 2.32 | 0.18 | 0.21 | 648 | 24 |
| 307 (Comparison) | 3-3 | No | — | 2.20 | 0.24 | 0.29 | 644 | 40 |
| 308 (The Invention) | " | 8 | $1.0 \times 10^{-2}$ | 2.21 | 0.18 | 0.25 | 644 | 40 |
| 309 (The Invention) | " | 21 | $1.0 \times 10^{-2}$ | 2.23 | 0.19 | 0.24 | 643 | 40 |
| 310 (Comparison) | 3-4 | No | — | 1.90 | 0.38 | 0.32 | 648 | 28 |
| 311 (The Invention) | " | 21 | $1.0 \times 10^{-2}$ | 2.05 | 0.20 | 0.29 | 648 | 29 |
| 312 (Comparison) | 3-5 | No | — | 1.95 | 0.32 | 0.32 | 642 | 45 |
| 313 (The Invention) | " | 21 | $1.0 \times 10^{-2}$ | 2.03 | 0.22 | 0.30 | 642 | 45 |

From the data of Table 4, it is noted that the samples of the present invention gave favorable results where the minimum image density (Dmin) was lowered while the maximum image density (Dmax) was high.

EXAMPLE 4

The following first to fourteenth layers were coated on the front surface of a paper support both surfaces of which were laminated with polyethylene (thickness: 100 microns), while the following fifteenth and sixteenth layers were coated on the back surface thereof. Accordingly a color photographic material sample was prepared. The polyethylene laminated on the front surface contained a white pigment of titanium white and a slight amount of an ultramarine bleuish dye.

Photographic Layer Compositions:

Components of the photographic layers to be coated on the support are described below, and the amount of each component coated is in terms of g/m². The amount of silver halide coated is in terms of the amount of silver therein. The emulsions used in the layers were prepared in the same manner as in preparation of Emulsion (3-3). The emulsion in the fourteenth layer was a Lippman emulsion which was not subjected to surface chemical sensitization.

| | |
|---|---|
| First Layer: Anti-Halation Layer | |
| Black Colloidal Silver | 0.10 |
| Gelatin | 0.70 |
| Second Layer: Interlayer | |
| Gelatin | 0.70 |
| Third Layer | |
| Low-Sensitivity Red-Sensitive Layer | |
| Silver Bromide Emulsion color- | 0.04 |

-continued

| | |
|---|---|
| sensitized with Red-Sensitizing Dye (S-36, 31, 16) (mean grain size 0.30 micron; grain size distribution as coefficient of variation 8%; octahedral grains) | |
| Silver Bromide Emulsion color-sensitized with Red-Sensitizing Dyes (S-36, 31, 16) (mean grain size 0.40 micron; grain size distribution coefficient of variation 10%; octahedral grains) | 0.08 |
| Gelatin | 1.00 |
| Cyan Coupler (ExC-1, 2, 3 of 1/1/0.2) | 0.30 |
| Anti-Fading Agent (Cpd-1, 2, 3, 4; 1/1/1/1) | 0.18 |
| Stain Inhibitor (Cpd-5) | 0.003 |
| Coupler Dispersing Agent (Cpd-6) | 0.03 |
| Coupler Solvent (Solv-1, 2, 3; 1/1/1) | 0.12 |
| Fourth Layer | |
| High-Sensitivity Red-Sensitive Layer | |
| Silver Bromide Emulsion color-sensitized with Red-Sensitizing Dye (S-36, 31, 16) (mean grain size 0.60 micron; size distribution 15%, octahedral grains) | 0.14 |
| Gelatin | 1.00 |
| Cyan Coupler (ExC-1, 2, 3; 1/1/0.2) | 0.30 |
| Anti-Fading Agent (Cpd-1, 2, 3, 4; 1/1/1/1) | 0.18 |
| Coupler Dispersing Agent (Cpd-6) | 0.03 |
| Coupler Solvent (Solv-1, 2, 3; 1/1/1) | 0.12 |
| Fifth Layer: Interlayer | |
| Gelatin | 1.00 |
| Color Mixing Inhibitor (Cpd-7) | 0.08 |
| Color Mixing Inhibitor Solvent (Solv-4, 5; 1/1) | 0.16 |
| Polymer Latex (Cpd-8) | 0.10 |
| Sixth Layer | |
| Low-Sensitivity Green-Sensitive Layer | |
| Silver Bromide Emulsion color-sensitized with Green-Sensitizing Dye (S-2) (mean grain size 0.25 micron; grain size distribution coefficient of variation 8%, octahedral grains) | 0.04 |
| Silver Bromide Emulsion as color-sensitized with Green-Sensitizing Dye (S-2) (mean grain size 0.40 micron; grain size distribution coefficient of variation 10%, octahedral grains) | 0.06 |
| Gelatin | 0.80 |
| Magenta Coupler (ExM-1, 2, 3 of 1/1/1) | 0.11 |
| Anti-Fading Agent (Cpd-9, 26; 1/1) | 0.15 |
| Stain Inhibitor (Cpd-10, 11, 12, 13; 10/7/7/1) | 0.025 |
| Coupler Dispersing Agent (Cpd-6) | 0.05 |
| Coupler Solvent (Solv-4, 6; 1/1) | 0.15 |
| Seventh Layer | |
| High-Sensitivity Green-Sensitive Layer | |
| Emulsion 1 color-sensitized with Green-Sensitizing Dye (S-2) (mean grain size 0.60 micron; grain size distribution coefficient of variation 11%; octahedral grains) | 0.10 |
| Gelatin | 0.80 |
| Magenta Coupler (ExM-1, 2, 3; 1/1/1) | 0.11 |
| Anti-Fading Agent (Cpd-9, 26; 1/1) | 0.15 |
| Stain Inhibitor (Cpd-10, 11, 12, 13; 10/7/7/1) | 0.025 |
| Coupler Solvent (Cpd-6) | 0.05 |
| Coupler Solvent (Solv-4; 6; 1/1) | 0.15 |
| Eighth Layer: Interlayer | |
| Same as Fifth Layer | |
| Ninth Layer: Yellow Filter Layer | |

-continued

| | |
|---|---|
| Yellow Colloidal Silver | 0.12 |
| Gelatin | 0.07 |
| Color Mixing Inhibitor (Cpd-7) | 0.03 |
| Color Mixing Inhibitor Solvent (Solv-4, 5; 1/1) | 0.10 |
| Polymer Latex (Cpd-8) | 0.07 |
| Tenth Layer: Interlayer | |
| Same as Fifth Layer | |
| Eleventh Layer | |
| Low-Sensitivity Blue-Sensitive Layer | |
| Silver Bromide Emulsion color-sensitized with Blue-Sensitizing Dye (ExS-5, 6) (mean grain size 0.40 micron; grain size distribution coefficient of variation 8%; octahedral grains) | 0.07 |
| Silver Bromide Emulsion as color-sensitized with Blue-Sensitizing Dye (ExS-5, 6) (mean grain size 0.60 micron; grain size distribution coefficient of variation 11%; octahedral grains) | 0.14 |
| Gelatin | 0.80 |
| Yellow Coupler (ExY-1, 2; 1/1) | 0.35 |
| Anti-Fading Agent (Cpd-14) | 0.10 |
| Stain Inhibitor (Cpd-5, 15; 1/5) | 0.007 |
| Coupler Dispersing Agent (Cpd-6) | 0.05 |
| Coupler Solvent (Solv-2) | 0.10 |
| Twelfth Layer | |
| High-Sensitivity Blue-Sensitive Layer | |
| Silver Bromide Emulsion as color-sensitized with Blue-Sensitizing Dye (ExS-5, 6) (mean grain size 0.85 micron; grain size distribution coefficient of variation 18%; octahedral grains) | 0.15 |
| Gelatin | 0.60 |
| Yellow Coupler (ExY-1, 2; 1/1) | 0.30 |
| Anti-Fading Agent (Cpd-14) | 0.10 |
| Stain Inhibitor (Cpd-5, 15; 1/5) | 0.007 |
| Coupler Dispersing Agent (Cpd-6) | 0.05 |
| Coupler Solvent (Solv-2) | 0.10 |
| Thirteenth Layer | |
| Ultraviolet Absorbing Layer | |
| Gelatin | 1.00 |
| Ultraviolet Absorbent (Cpd-2, 4, 16; 1/1/1) | 0.50 |
| Color Mixing Inhibitor (Cpd-7, 17; 1/1) | 0.03 |
| Dispersing Agent (Cpd-6) | 0.02 |
| Ultraviolet Absorbent Solvent (Solv-2, 7; 1/1) | 0.08 |
| Anti-Irradiation Dye (Cpd-18, 19, 20, 21, 27; 10/10/13/15/20) | 0.05 |
| Fourteenth Layer: Protective Layer | |
| Fine Silver Chlorobromide Grains (silver chloride 97 mol %; mean grain size 0.1 micron) | 0.03 |
| Acryl-Modified Copolymer of Polyvinyl Alcohol | 0.01 |
| Mixture of Polymethyl Methacrylate Grains (mean grain size 2.4 microns) and Silicon Oxide Grains (mean grain size 5 microns) (1/1 mixture) | 0.05 |
| Gelatin | 1.80 |
| Gelatin Hardening Agent (H-1, H-2; 1/1) | 0.18 |
| Fifteenth Layer: Backing Layer | |
| Gelatin | 2.50 |
| Ultraviolet Absorbent (Cpd-2, 4, 16; 1/1/1) | 0.50 |
| Dye (Cpd-18, 19, 20, 21, 27; 1/1/1/1/1) | 0.06 |
| Sixteenth Layer | |
| Backing Layer-Protecting Layer | |
| Mixture of Polymethyl Methacrylate Grains (mean grain size 2.4 microns) and Silicon Oxide Grains (mean grain size 5 micron) (1/1 mixture) | 0.05 |
| Gelatin | 2.00 |

-continued

| | |
|---|---|
| Gelatin Hardening Agent (H-1, H-2; 1/1) | 0.14 |

The respective light-sensitive layers contained Nucleating Agent N-1-17 in an amount of $5\times10^{-7}$ mol per mol of silver halide and Nucleation Accelerator Cpd-22 in an amount of $10^{-2}$% by weight to the amount of silver halide coated. Additionally, the respective layers contained Alkanol XC (manufactured by DuPont) and sodium alkylbenzenesulfonate as emulsification and dispersion aids and succinate and Magefac F-120 (manufactured by Dainippon Ink) as coating aids. The layers containing silver halide and colloidal silver further contained a stabilizer (Cpd-23, 24, 25). The photographic material sample thus prepared was called Sample No. 401.

The compounds used in the above examples are described below.

ExS-5:

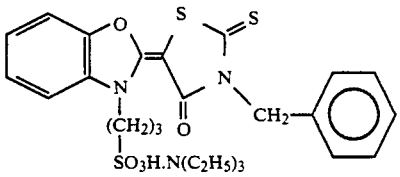

ExS-6:

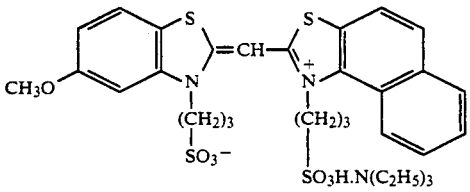

Cpd-1:

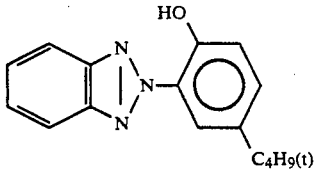

Cpd-2:

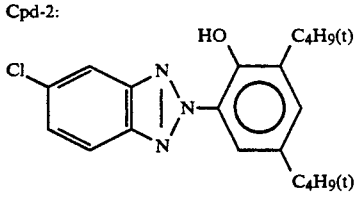

Cpd-3:

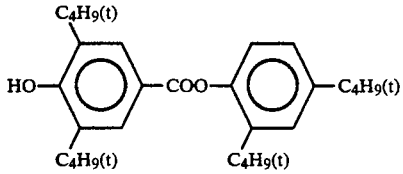

Cpd-4:

-continued

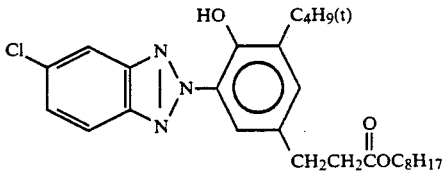

Cpd-5:

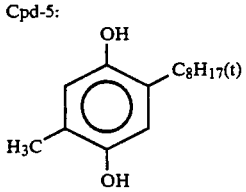

Cpd-6:

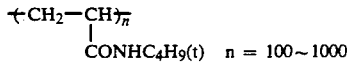

Cpd-7:

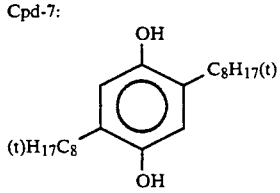

Cpd-8:

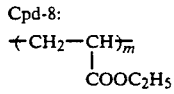

Cpd-9:

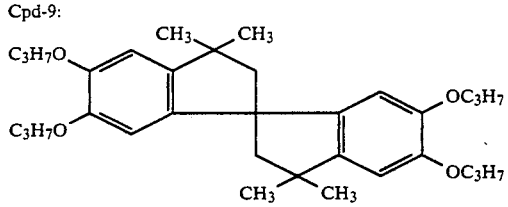

Cpd-10:

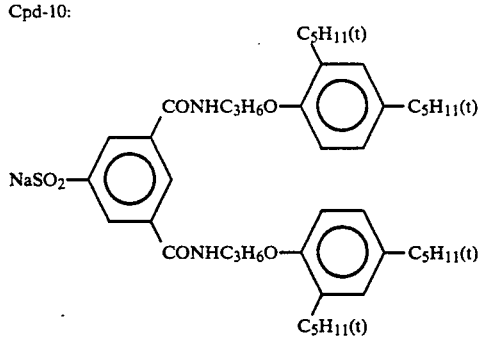

Cpd-11:

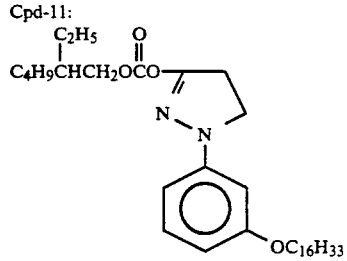

Cpd-12:

-continued
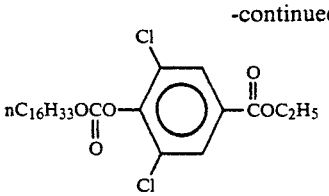
Cpd-13:
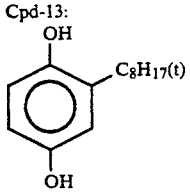
Cpd-14:
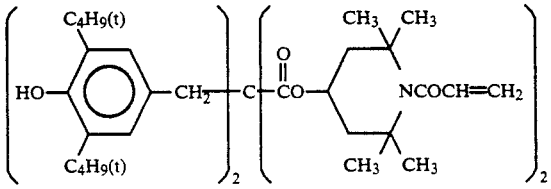
Cpd-15:
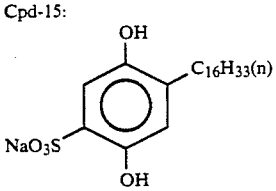
Cpd-16:
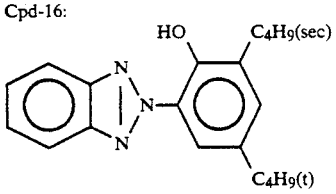
Cpd-17:
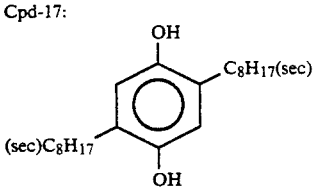
Cpd-18:
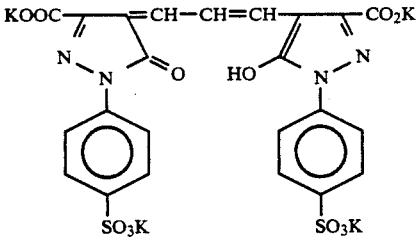
Cpd-19:
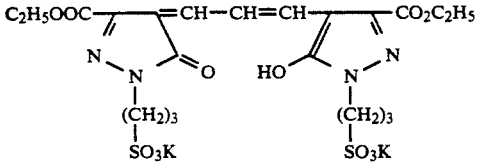
-continued
Cpd-20:
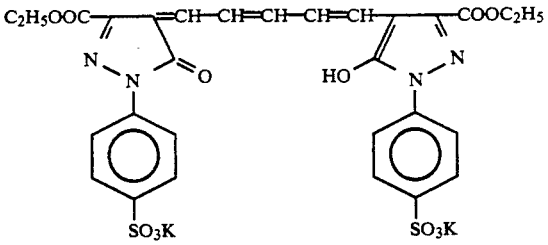
Cpd-21:
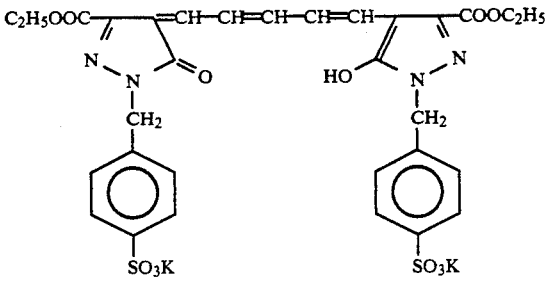
Cpd-22:
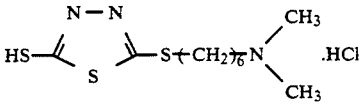
Cpd-23:
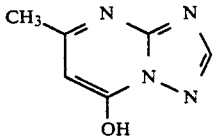
Cpd-24:
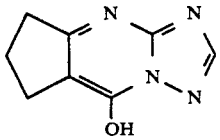
Cpd-25:
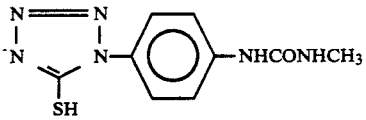
Cpd-26:
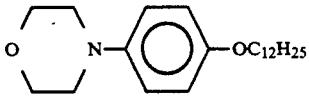
Cpd-27:
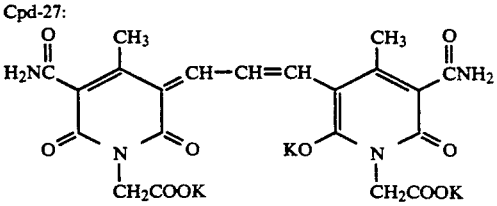
ExC-1:

-continued

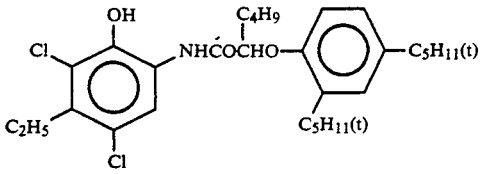

ExC-2:

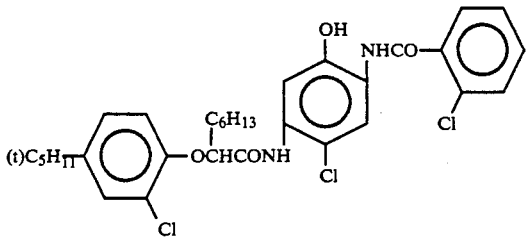

ExC-3:

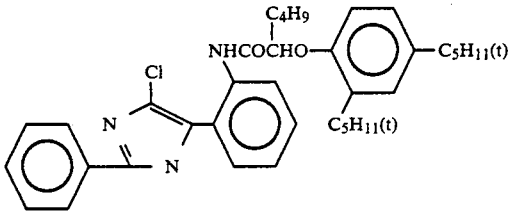

ExM-1:

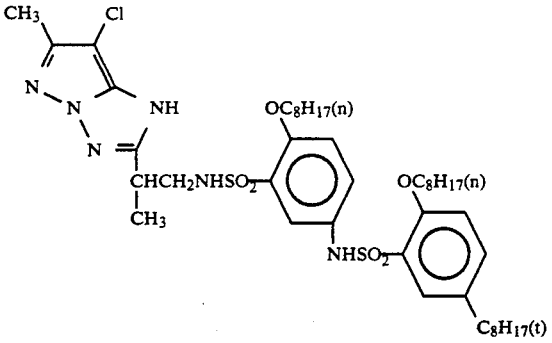

ExM-2:

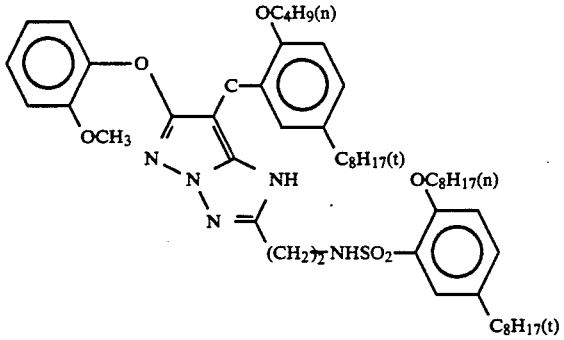

ExM-3:

-continued

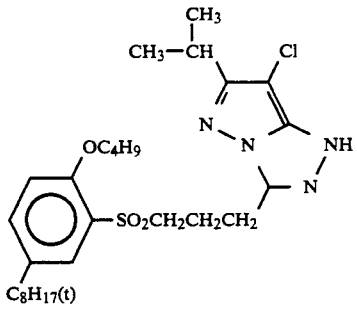

ExY-1:

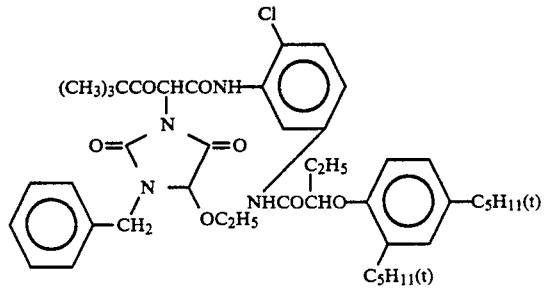

ExY-2:

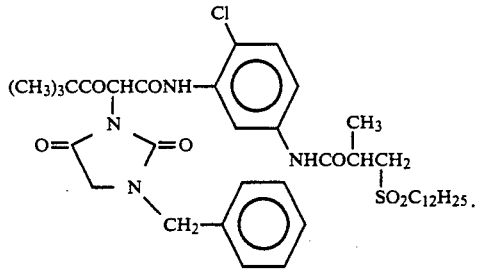

Solv-1:
Di(2-ethylhexyl) Sebacate
Solv-2:
Trinonyl Phosphate
Solv-3:
Di(3-methylhexyl) Phthalate
Solv-4:
Tricresyl Phosphate
Solv-5:
Dibutyl Phthalate
Solv-6:
Trioctyl Phosphate
Solv-7:
Di(2-ethylhexyl) Phthalate
H-1:
1,2-bis(Vinylsulfonylacetamido)ethane
H-2:
4,6-Dichloro-2-hydroxy-1,3,5-triazine Sodium Salt Other samples (Samples Nos. 402 to 405) were prepared in the same manner as in preparation of Sample No. 401, except that compound of condition-1 of the present invention (as shown in Table 5 below) was added to the third and fourth layers.

Sample No. 406 was prepared in the same manner as in preparation of Sample No. 401, except that the emulsions in the third and fourth layers in Sample No. 401 were replaced by cubic grains-containing emulsions prepared in the same manner as in the preparation of Emulsion (3-1) in Example 3. Further, Samples Nos. 407 to 410 were prepared in the same manner as in the preparation of Sample No. 406 except that compound of condition-1 of the present invention (as shown in Table 5 below) was added to the third and fourth layers.

In order to evaluate the color-reproducibility of the thus prepared samples, the samples were subjected to the following test. More specifically, a Mackbeth Color Checker was photographed with a color negative film (SHR-100, manufactured by Fuji Photo Film) and then printed on a color paper (02-A, manufactured by Fuji Photo Film) to prepare an original image. The original was printed on each of Samples Nos. 401 to 410 using a reflection type printer and thereafter the samples were developed in accordance with the above-described processing procedure to prepare color prints. The density and color of the print were so adjusted that the gray patch of Netural-5 of the Mackbeth Color Checker on the color paper original was a gray color having a density of 1.0 on the print.

With respect to the red, green and blue color patches of the Mackbeth Color Chart on the prints obtained, HVC values (as corrected Munsell system symbols) were measured, and the C value is shown in Table 5 below. Where the sample tested has a higher C value, the color reproducibility of the sample is higher with respect to color saturation. Additionally, it has been ascertained that the value corresponds to the visual clearness and vividness of each color when the print is visually observed with the naked eye.

TABLE 5

| Sample No. | Proportion of (100) Faces in Grain Emulsion Used: Third Layer 0.3 μ | Third Layer 0.4 μ | Fourth Layer 0.6 μ | Compound of Condition-1 Added to Third and Fourth Layers: Kind | Amount Added (mol/mol-Ag) | Characteristic Values of RL-Characteristic Curve: $D_{max}$ | $D_{min}$ | $G_{0.8/0.2}$ | Chloro Value of Red Patch on Print | Cyan Density In White Background on Print |
|---|---|---|---|---|---|---|---|---|---|---|
| 401 (Comparison) | 8 | 11 | 12 | No | No | 2.50 | 0.12 | 0.52 | 8.5 | 0.24 |
| 402 (The Invention) | " | " | " | 8 | $8 \times 10^{-3}$ | 2.55 | 0.08 | 0.40 | 9.6 | 0.15 |
| 403 (The Invention) | " | " | " | 11 | $5 \times 10^{-4}$ | 2.53 | 0.09 | 0.45 | 9.5 | 0.15 |
| 404 (The Invention) | " | " | " | 22 | $8 \times 10^{-3}$ | 2.53 | 0.08 | 0.42 | 9.8 | 0.13 |
| 405 (The Invention) | " | " | " | 24 | $8 \times 10^{-3}$ | 2.51 | 0.08 | 0.39 | 9.7 | 0.13 |
| 406 (Comparison) | 98 | 95 | 95 | No | No | 2.30 | 0.18 | 0.83 | 8.9 | 0.29 |
| 407 (The Invention) | " | " | " | 8 | $8 \times 10^{-3}$ | 2.56 | 0.08 | 0.35 | 9.8 | 0.15 |
| 408 (The Invention) | " | " | " | 11 | $5 \times 10^{-4}$ | 2.60 | 0.06 | 0.33 | 9.8 | 0.13 |
| 409 (The Invention) | " | " | " | 22 | $8 \times 10^{-3}$ | 2.70 | 0.07 | 0.34 | 9.8 | 0.14 |
| 410 (The Invention) | " | " | " | 24 | $1 \times 10^{-3}$ | 2.66 | 0.06 | 0.30 | 9.7 | 0.13 |

As is obvious from the results in Table 5 above, the direct positive prints obtained in accordance with the present invention have an excellent whiteness in the white background areas and additionally have a noticeably improved red color-reproducibility. The vivid contrast between the white background and the red image areas was also obvious on visual comparison using practical prints.

In accordance with the method of the present invention, a photographic material which has a previously non-fogged internal latent image-type silver halide emulsion containing a color sensitizing dye, especially a J-band type dye, along with a particular compound which satisfy the condition-1, is imagewise exposed and then color-developed during or after fogging to form a direct positive color image. Accordingly, the maximum image density (Dmax) of the image formed may be elevated while the minimum image density (Dmin) thereof is lowered, and therefore the whiteness of the white background areas of the color image formed is elevated and the red color-reproducibility is especially improved.

While the invention has been described in detail and with reference to specific embodiments thereof, it will be apparent to one skilled in the art that various changes and modifications can be made therein without departing from the spirit and scope thereof.

What is claimed is:

1. A method of forming a direct positive color image comprising image-wise exposing a photographic material having at least one emulsion layer which contains previously non-fogged internal latent image-type silver halide grains on a support and then color-developing the exposed photographic material during or after fogging, wherein the photographic material contains (A) a color sensitizing dye and (B) at least one tricyclic or tetracyclic heterocyclic compound or salt thereof which satisfies the following condition-1:

Condition-1: 2 ml of an aqueous solution of $4.0 \times 10^{-4}$ mol/liter of anhydro-5,5'-dichloro-9-ethyl-3,3 '-bis(3-sulfo-propyl) thiacarbocyanine-hydroxide pyridinium salt and 1 ml of an aqueous solution of $1.0 \times 10^{-1}$ mol/liter of potassium chloride are blended, and 4 ml of an aqueous solution of $8.0 \times 10^{-2}$ mol/liter of the compound (B) to be added to the photographic material is added to the resulting blended solution, which is then diluted with water to make 10 ml; with the molecular extinction coefficient of the resulting aqueous solution at 624 nm being $1.0 \times 10^5$ or less, wherein said tricyclic or tetracyclic heterocyclic compound comprises a structural formula selected from the following formulae:

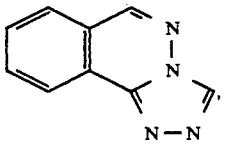

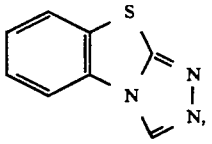

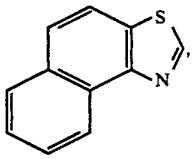

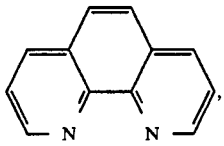

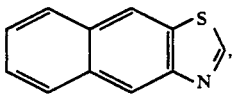

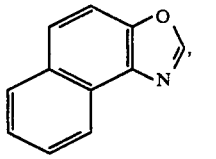

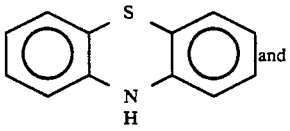

and

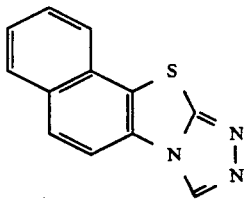

wherein said tricyclic or tetracyclic heterocyclic compound may be substituted by a halogen atom, —OM (in which M represents a hydrogen atom or a monovalent metal such as Na, K or Li), a substituted or unsubstituted alkyl group, a substituted or unsubstituted aryl group, a substituted or unsubstituted alkoxy group, a substituted or unsubstituted amino group, a cyano group, a nitro group, a sulfo group, a carboxyl group, a substituted or unsubstituted aryloxy group, a substituted or unsubstituted alkylthio group, a substituted or unsubstituted arylthio group, a substituted or unsubstituted acyl group, a substituted or unsubstituted aminosulfonyl group, a substituted or unsubstituted alkoxycarbonyl group, a substituted or unsubstituted aryloxycarbonyl group, or a substituted or unsubstituted aminocarbonyl group.

2. The method of forming a direct positive color image as in claim 1, in which the compound (B) which satisfies condition-1 is added to the color-sensitized silver halide photographic emulsion prior to addition of the color sensitizing dye (A) thereto.

3. The method of forming a direct positive color image as in claim 1, in which the silver halide grains are cubic grains or essentially (100) face tetradecahedral grains.

4. The method of forming a direct positive color image as in claim 1, in which the color sensitizing dye (A) is a compound of the general formula (V):

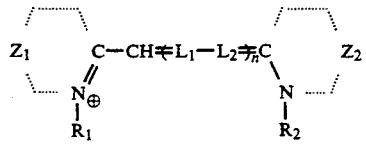

(V)

where $Z_1$ and $Z_2$ may be same or different and each represents an atomic group necessary for forming a benzothiazole nucleus, a naphthothiazole nucleus, a benzoxazole nucleus, a naphthoxazole nucleus, a benzimidazole nucleus, a benzoselenazole nucleus or a naphthoselenazole nucleus;

$R_1$ and $R_2$ may be same or different and each represents a substituted or unsubstituted alkyl group, provided that at least one of $R_1$ and $R_2$ contains a sulfo group or a carboxyl group;

$L_1$ and $L_2$ may be same or different and each represents a substituted or unsubstituted methine group; and n represents an integer of from 0 to 2.

5. The method of forming a direct positive color image as in claim 1, wherein photographic material said method includes color-developing said exposed in the presence of a nucleating agent of the general formula (N-1):

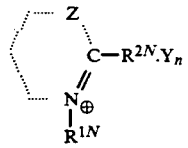

(N-1)

where

Z represents a non-atomic group necessary for forming a 5- or 6-membered hetero ring, which may be substituted; $R^{1N}$ represents an aliphatic group, which may be substituted; $R^{2N}$ represents a hydrogen atom, an aliphatic group or an aromatic group, which may be substituted; or $R^{2N}$ may be bonded to the hetero ring completed by Z to form a ring; provided that at least one of $R^{1N}$, $R^{2N}$ and Z contains an alkynyl group, an acyl group, a hydrazine group or a hydrazone group, or $R^{1N}$ and $R^{2N}$ form a 6-membered ring to complete a dihydropyridinium skeleton; and at least one of $R^{1N}$, $R^{2N}$ and Z may have a silver halide adsorption-accelerating group;

Y represents a charge balancing ion for charge balance of the compound; and n represents 0 or 1.

6. The method of forming a direct positive color image as in claim 1, wherein the compound (B) which satisfies condition-1 is contained in an amount of from $10^{-4}$ to $10^{-1}$ mol per mol of silver halide.

7. The method of forming a direct positive color image as in claim 1, wherein the color sensitizing dye (A) is contained in an amount of from $5\times10^{-7}$ to $5\times10^{-2}$ mol per mol of silver halide.

8. The method for forming a direct positive color image as in claim 1, wherein the tricyclic or tetracyclic heterocyclic compound is substituted by an alkyl group having 20 or less carbon atoms, an aryl group having 15 or less carbon atoms, an alkoxy group having 20 or less carbon atoms, a substituted amino group 20 or less carbon atoms, an aryloxy group having 20 or less carbon atoms, an alkylthio group having 20 or less carbon atoms, an arylthio group having 20 or less carbon atoms, an acyl group having 20 or less carbon atoms, a substituted aminosulfonyl group having 20 or less carbon atoms, an alkoxycarbonyl group having 20 or less carbon atoms, an aryloxycarbonyl group having 20 or less carbon atoms, or a substituted aminocarbonyl group having 20 or less carbon atoms.

* * * * *